US006631594B2

(12) United States Patent
Whiting

(10) Patent No.: US 6,631,594 B2
(45) Date of Patent: Oct. 14, 2003

(54) COMPONENTS FOR ROOF ASSEMBLIES

(75) Inventor: Richard Anthony Whiting, Mickleover (GB)

(73) Assignee: R A Whiting Design Limited (GB)

( * ) Notice: Subject to any disclaimer, the term of this patent is extended or adjusted under 35 U.S.C. 154(b) by 31 days.

(21) Appl. No.: 09/749,312

(22) Filed: Dec. 27, 2000

(65) Prior Publication Data

US 2001/0013208 A1 Aug. 16, 2001

(30) Foreign Application Priority Data

Jan. 6, 2000 (GB) ..... 0000129

(51) Int. Cl.[7] ..... E06B 3/964
(52) U.S. Cl. ..... 52/204.69; 52/90.1; 52/204.5
(58) Field of Search ..... 52/90.1, 204.5

(56) References Cited

U.S. PATENT DOCUMENTS

| | | | | | |
|---|---|---|---|---|---|
| 2,213,402 | A | * | 9/1940 | Lowry | 52/204.57 |
| 5,826,380 | A | * | 10/1998 | Wolfe | 52/277 |
| 5,927,027 | A | * | 7/1999 | Richardson | 52/13 |
| 6,000,176 | A | * | 12/1999 | Lancaster | 52/198 |
| 6,223,481 | B1 | * | 5/2001 | Rickman | 52/460 |

FOREIGN PATENT DOCUMENTS

| | | | |
|---|---|---|---|
| EP | 0 610 102 | A1 | 8/1994 |
| EP | 0 794 298 | A1 | 9/1997 |
| EP | 0 821 116 | A1 | 1/1998 |
| EP | 0 863 272 | A2 | 9/1998 |
| EP | 0 864 707 | A2 | 9/1998 |
| EP | 0 878 592 | A2 | 11/1998 |
| EP | 0 924 362 | A2 | 6/1999 |
| GB | 2247474 | A | 8/1990 |
| GB | 2256880 | | 10/1991 |
| GB | 2 256 658 | A | 12/1992 |
| GB | 2259926 | A | 3/1993 |
| GB | 0559292 | A1 | 5/1993 |
| GB | 2 275 064 | A | 8/1994 |
| GB | 2 281 325 | A | 3/1995 |
| GB | 2 335 667 | A | 9/1999 |
| GB | 2 335 676 | A | 9/1999 |

* cited by examiner

*Primary Examiner*—Carl D. Friedman
*Assistant Examiner*—Steve Varner
(74) *Attorney, Agent, or Firm*—Watts Hoffmann Co., L.P.A.

(57) ABSTRACT

Components for a roof assembly include a glazing having a main support member and a cap engaging member. The cap engaging member has a detent portion extending from an edge region back towards an opposite edge region. The component also includes a beam member a main support member and a rafter support member for supporting a rafter assembly. The rafter support member has a securing portion extending from an edge region. A ridge end member is also disclosed which has a plurality of segment extending radially outwardly from a hub member. Each segment has an elongate mounting member on an edge opposite the hub member. There is also disclosed a wing member for a valley rafter assembly. The wing member has first and second elements secured together. Each of the elements comprises a portion of a mounting formation to which a glazing bar can be mounted. The components further include a bracket arrangement comprising a first bracket mountable on a first rafter assembly, and a second bracket mountable on a second rafter assembly. Securing means is provided to secure the first bracket to the second bracket.

14 Claims, 17 Drawing Sheets

COMPONENTS FOR ROOF ASSEMBLIES

FIELD OF INVENTION

This invention relates to components for roof assemblies. More particularly, but not exclusively, the invention relates to components for roof assemblies for conservatories and greenhouses.

BACKGROUND OF INVENTION

The construction of conservatories requires the beams and rafters to be of sufficient strength but also to be sufficiently lightweight. Many designs of profiles for conservatories require considerable amounts of material to provide the required strength and rigidity. This creates cost and weight disadvantages.

In addition, many known conservatories require a large number of components in order to be able to construct the configurations and sizes of conservatories that may be desired.

SUMMARY OF INVENTION

According to one aspect of this invention there is provided a glazing bar comprising a main support member and a cap engaging member on an edge region of the main support member, the cap engaging member comprising a detent portion extending from said edge region towards an opposite edge region of the main support member to engage a selected one of a plurality of corresponding detents on a cap to be engaged by the cap engaging member.

Preferably, the cap engaging member includes two of said detent portions, each extending on opposite sides of the main support member toward said opposite edge thereof.

The main support member may be formed from two elements secured together wherein the cap engaging member is in the form of folded back portions at the edge region of each element.

A second cap engaging member may extend outwardly from said opposite edge region of the main support member and may comprise an upstanding member extending toward the first cap engaging member. In one embodiment the second cap engaging member may further include a curved portion extending inwardly from the upstanding member. The curved portion may be adapted to engage a part of a second cap, whereby the curved portion is so curved such that said part of the second cap extends in use substantially tangentially to the curved portion.

The glazing bar is preferably formed of a steel material, or other suitable material, for example aluminium.

Preferably, the second cap engaging member extends from the support member in substantially opposite directions, and the cap engaging member comprises two of said upstanding members and a curved portion on each upstanding member.

The second cap engaging member may include at least one outwardly extending strip, preferably first and second outwardly extending strips, the or each strip extending from the main support member, and desirably, in the case of first and second outwardly extending strips, in opposite directions to each other. The or each of said outwardly extending strips preferably includes a raised portion so shaped that a fastening member, for example a bolt, may extend through said raised portion such that a part of the fastening member, for example a head of the bolt, engages the raised portion, generally or approximately tangentially therewith.

Preferably, the, or each, detent portion on the first cap engaging member is adapted to co-operate with a selected detent formation on said first cap, whereby the position of the first cap on the glazing bar may be adjusted. Each of said detent formations may be provided with a plurality of inwardly extending triangular detents arranged one after the other on said first cap. Preferably, the respective triangular detents closest to the further cap have a width which is less than the width of succeeding triangular formations further away from said further cap. Preferably, each detent formation include three of said triangular detents.

According to another aspect of this invention there is provided a beam member for a roof arrangement, the beam member comprising a main support member and a rafter support member extending outwardly from the main support member, wherein securing means is provided on the rafter support member at an edge region of the rafter support member, the securing means comprising upstanding means extending from the rafter support member and adapted to cooperate with a part of a securing member of a rafter assembly.

In a first embodiment, the upstanding means may comprise a first upstanding member extending from the rafter support member and a second member extending from the first member back toward the rafter support member.

In this embodiment the second member extends inwardly of the rafter support member. The upstanding means may define a recess to receive a cooperating part of a securing member of a rafter assembly, the recess allowing said cooperating part to move to accommodate a desired position of the rafter assembly.

The beam member is preferably formed of a steel material or other suitable material for example aluminium.

The securing means preferably includes pivot receiving means which may comprise a curved member, for receiving a pivot on the securing member, whereby the securing means allows the rafter to pivot to said desired position about the pivot receiving means.

Preferably, the securing means includes a stop member to prevent movement of the co-operating part therebeyond. The securing means may include a holding region, whereby the co-operating part of the rafter is held between the recess and the holding portion.

Preferably, the rafter support member extends outwardly in opposite directions from the main support member. Each of said rafter support members may comprise securing means as described above.

The, or each, rafter support member as described above may be provided along one edge region of the main support member. A further rafter support member may be provided along the opposite edge region of the main support member. The further rafter support member may comprise a securing means having the features as described above. In the preferred embodiment, the second rafter support member may extend on opposite sides of said main support member, and each may comprise a securing means at the free edge region on each side. Each securing means may be as described above. Preferably, the, or each securing means is adapted to engage on an outward surface thereof of the holding member for a cap to be secured to the beam member.

In a second embodiment, the upstanding means comprises a step extending outwardly of the rafter support member and adapted to cooperate with a detent on a securing member of a rafter assembly. Preferably the upstanding means comprises a first upstanding member extending from the rafter support member and a second member extending from the first member back toward the rafter support member outwardly of the rafter support member to provide said step.

The rafter support member may comprise means for holding a cap engaging member. Preferably the rafter support member is shaped to provide a re-entrant aperture to hold a cap engaging member. Preferably two of said rafter support members are provided on opposite sides of the main support member and, together, the rafter support members may be so shaped to define the aperture.

According to another aspect of this invention there is provided a roof assembly comprising a beam member as described above and a rafter assembly, wherein the rafter assembly comprises a rafter and a securing member on the rafter to secure the rafter assembly to the beam member, the securing member including a co-operating part which can cooperate with the securing means on the beam member to secure the rafter assembly to the beam member.

In one embodiment, the co-operating part on the securing member of the rafter assembly can be received in the recess in the securing means of the first embodiment to secure the rafter assembly to the beam member. The cooperating part may be in the form of a limb member having one end region receivable in the pivot receiving means, and may also include another end region which can engage the stop member, thereby being prevented from moving beyond it.

The rafter assembly may further include a glazing bar, which may be as described above, the glazing bar having capping means on one end thereof. The capping means may comprise a first capping member having the securing member thereon. The first capping member may also include a holding means for holding a fastening member to fasten the first capping member to the glazing bar.

The holding means may comprise a channel member defining a channel having an open side and inwardly extending flange members extending from opposite side walls of the channel member part way across the open side, whereby the channel can receive the head of a bolt.

The first capping member may further include adjustment means adapted to cooperate with second adjustment means on the second capping member.

The first and second adjustment means may cooperate with each other to adjust the height of the capping means for different heights of the glazing bar.

Preferably the first adjustment means comprises a planar member having a plurality of outwardly extending detents each extending lengthwise along at least one side, and preferably both sides. The second adjustment means may comprise a pair of generally parallel planar members, at least one of which, and preferably each planar member, has a plurality of inwardly extending detents to engage and cooperate with the outwardly extending detents on the first adjustment means.

The second capping member also includes a curved portion to engage the glazing bar wherein the curved portion defines an arc whereby the radius of said arc extends generally from the pivot on the securing member of the first capping member.

In another embodiment, the rafter assembly includes clip holding means to secure thereto a clip for holding the rafter. The clip holding means may comprise a securing formation to cooperate with the step of the second embodiment to secure the clip holding means to the upstanding means.

The clip holding means may comprise a channel member defining a channel having an open side and a pair of flanges extending inwardly from opposite side walls of the channel member part way across said open side.

Preferably, the clip holding means includes a stop member to engage the rafter support member to prevent or inhibit movement of the clip holding member.

According to another aspect of this invention there is provided a ridge end member for a hipped roof arrangement, the ridge end member comprising a plurality of segments extending radially outwardly from a hub member, and each segment comprising an elongate mounting member on an edge thereof opposite the hub member to which a plurality of glazing bars can be mounted.

The ridge end member is advantageously formed of a suitable material which can be formed into shape and has sufficient strength, for example aluminium, a moulded plastics material, such as a mineral filled nylon, or a cast metal, such as zinc alloy or aluminium alloy.

Preferably, each mounting member is attached to its respective segment by a length of material having a thickness which is less than the thickness of the respective mounting member.

The ridge end member may further include a plurality of sleeves, wherein at least a respective one of said sleeves is slidable over a respective mounting member. Preferably, the mounting members are of a substantially circular cross-section, and the sleeves have a cross-section corresponding to the mounting members. Preferably, each of the mounting members is pivotable about its principal axis on the respective mounting member. The sleeves may be formed of a suitable material which can be formed into shape and has sufficient strength for example a material from which the ridge end member can be formed.

Each of the sleeves may comprise a formation to which a glazing bar may be secured. Preferably, the formation comprises a groove formed in the sleeve. Preferably, the groove has a generally T-shaped configuration.

The hub member may be provided to connect the ridge end to a ridge part of the roof. The hub member may be of a T-shaped configuration which may have first and second elongate slots on either arm of the T, and a recess may be defined in the body of the T. Preferably, at the end of the T, a further elongate slot may be provided.

A connecting device may be provided to connect the ridge end member to said part of the roof arrangement. Preferably, the connecting device comprises a first connecting projection receivable in the said recess, and a second connecting projection attachable to said part of the roof. Preferably, an attachment member, which may comprise a plate is provided between the first and second connecting projections. The attachment member may be provided with apertures through which fastening devices, for example screws or bolts, may be inserted to be received in the first and second slots. The first connecting projection may be provided with a bore to be arranged in register with the third slot and connected thereto using suitable fastening means, for example a bolt. The connecting device may be formed of a suitable material which can be formed into shape and is of sufficient strength, for example, a material from which the ridge end member can be formed.

The connecting device may be provided with indicia to represent the angle to the horizontal at which the glazing bars can extend therefrom. The indicia are preferably in the form of graduations provided on the attachment member and may be so arranged that alignment of the top of the hub member with a selected one of said graduations indicates the angle at which the glazing bars should extend from the ridge end member.

According to a further aspect of the invention, there is provided a wing member for a valley rafter assembly, the wing member comprising first and second elements secured together, wherein each of the first and second elements comprises a portion of a mounting formation, and the first and second elements being arranged such that the mounting portions together form the mounting formation to which a glazing bar can be mounted.

Preferably, each of the first and second elements is in the form of an elongate strip which are desirably secured together lengthwise of each other in face-to-face contact along a part of the width of each strip.

The mounting formation may be in the form of an elongate open-topped channel, which may receive therein a part of a fastening means, for example a head of a bolt, to fasten the glazing bar to the wing member.

In a preferred embodiment, each of the first and second elements further includes a portion of a pivot receiving formation, such that the pivot receiving portions together form the pivot receiving formation to receive a pivot member. Thus, in this embodiment, the wing member can pivot about the pivot member.

The wing member may further include an upstanding portion which is preferably formed from one of the first and second elements. The upstanding portion is preferably configured to cooperate with a capping. Preferably, the upstanding portion includes a capping engaging region formed from a folded section of the upstanding portion. Preferably, the folded section includes a first folded member in which the upstanding portion is folded back upon itself, and may further include a second folded member in which the first folded member is folded back upon itself, whereby the second folded member is arranged between the upstanding portion and the first folded member.

According to another aspect of this invention there is provided a valley rafter assembly comprising first and second wing members, at least one of said wing members being as described above.

Preferably, both of the first and second wing members are as described above. The first and second wing members may be arranged in mirror image relationship.

The first and second wing members are preferably movable relative to each other and the assembly may include a pivot to pivotally connect the first and second wing members together. The assembly may include a capping member to be secured to the first and second wing members.

According to another aspect of this invention, there is provided a bracket arrangement for connecting a first rafter assembly to a second rafter assembly, the bracket arrangement comprising a first bracket mountable on the first rafter assembly and a second bracket mountable on the second rafter assembly, and the arrangement further including securing means for securing the first bracket to the second bracket, wherein the first bracket comprises a first main portion and first means for holding the securing means in adjustable relationship relative to the first main portion, and the second bracket comprises a second main portion and second means for holding the securing means in adjustable relationship relative to the second main portion.

Preferably, the first holding means comprises a channel member defining an open-topped channel for receiving a part of the securing means therein. Preferably, the channel is elongate and the securing means is movable lengthwise of the channel. The first holding means may be pivotally attached to the first main portion and may be so attached lengthwise of the first main portion. The holding means may be pivotally attached to the first main portion by an elongate pivot pin.

The first main portion may have a generally L-shaped profile, and the holding means may be mountable on the first main portion at the lower limb of the L.

The second holding means may comprise an elongate projection extending from the second main portion and defining at the free end thereof a receiving member to receive a part of the securing means. Preferably, said part of the securing means is movable within the receiving member to adjust the position of the second rafter relative to the first rafter.

Preferably, the second main portion comprises a pair of rafter engaging members connected together by said elongate projection, whereby the rafter engaging members can be arranged one on either side of the rafter.

The receiving member may have an annular configuration and the projection may include an elongate member extending from each of the rafter engaging members to the receiving member.

The securing means may be in the form of a bolt. The head of the bolt may be received in the channel of the channel member and the shank of the bolt may be received by the receiving member to be secured thereto by a nut.

Each of the first and second brackets is preferably fastened to the respective first and second rafter assemblies by fastening means which may be in the form of nuts and bolts. Each of the main portions of the first and second brackets may define an aperture through which the fastening means can extend. The apertures may be in the form of slots.

BRIEF DESCRIPTION OF THE DRAWINGS

Embodiments of the invention will now be described by way of example only with reference to the accompanying drawings, in which.

DETAILED DESCRIPTION OF THE INVENTION

Figure 1A:
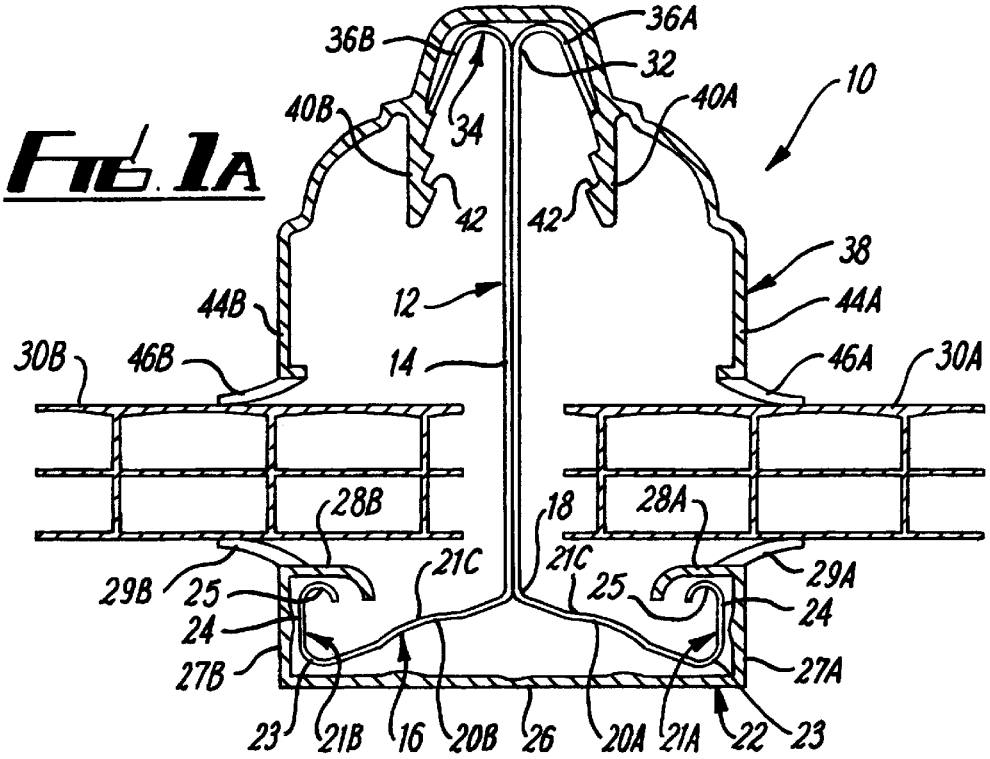
FIGS. 1A to 1F are cross-sectional end views of rafter arrangements.
Figure 1B:
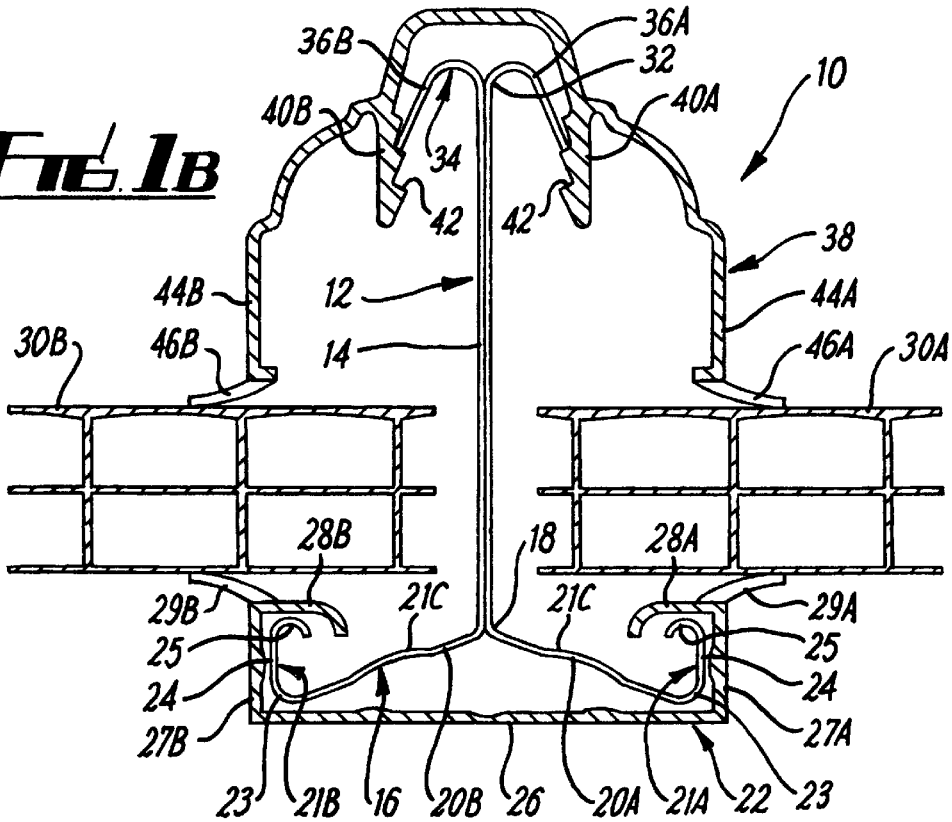
Figure 1C:
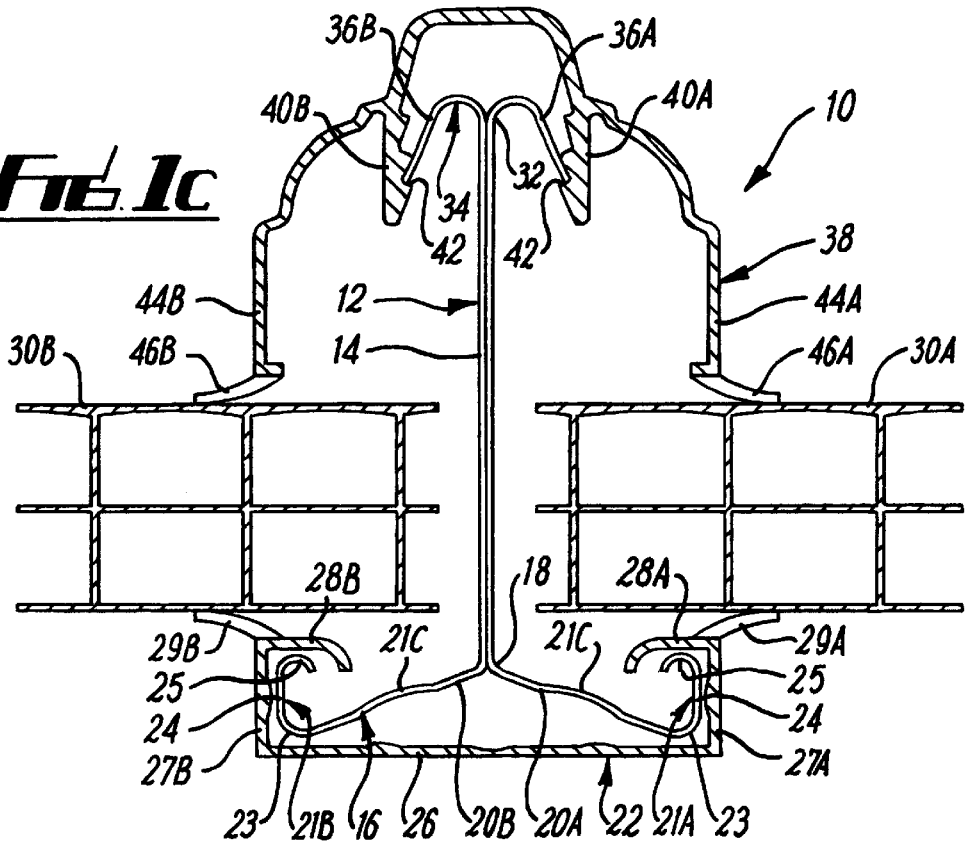

Referring to FIGS. 1A to 1C, there are shown three versions of a rafter arrangement 10, the versions being identical, with the exception that they are each holding a different thickness of glazing 30A, 30B.

In FIGS. 1A to 1C, the rafter arrangement 10 comprises a glazing bar 12 comprising a main support member 14, and a first cap engaging member 16 extending from an edge region 18 of the support member 14. The glazing bar 12 is preferably formed of a steel material, but can be formed of any other suitable material, for example aluminium. The cap engaging member 16 comprises first and second outwardly extending portions 20A, 20B extending in opposite directions from the support member 14, and at the opposite free edge regions of each of the outwardly extending portions 20A, 20B there is provided a securing portion 21A, 21B to which an elongate cap 22, formed of a suitable plastics material is secured, the cap 22 extending the length of the glazing bar 12.

Each of the securing portions 21A, 21B comprises an outwardly curved portion 23, an upwardly extending straight portion 24 running substantially parallel to the support member 14, and an inwardly curved portion 25. The cap 22 comprises a base member 26 and side portions 27A, 27B which, extend upwardly from the base portion 26 to run parallel to the respective straight portions 24 of the securing portions 21A, 21B, and inwardly extending portions 28A, 28B, sealing members 29A, 29B extend from the inwardly extending portions 28A, 28B respectively and engage the glazing members 30A, 30B.

At the upper edge region 32 of the support member 14 there is provided a second cap engaging member 34 which comprises a first outwardly extending portion 36A extending on one side of the support member 14, and a second outwardly extending member 36B on the opposite side of the support member 14. The first and second outwardly extending portions 36A, 36B point towards the first cap engaging member 16. The second cap engaging member 34 engages a second elongate cap 38 which is provided with inwardly extending barbed members 40A, 40B each being provided with a plurality of upwardly facing barbs 42. As can be seen in FIG. 1A, the outwardly extending portions 36A, 36B engage the upper barbs 42 on the second cap 38. Each side of the cap 38 comprises a respective arm 44A, 44B which terminate at a respective seal 46A, 46B which engages the upper surface of the respective glazing 30A, 30B.

As can be seen, in FIG. 1A, the glazings 30A 30B to be held are narrow and, hence, the outwardly extending portions 36A, 36B of the further cap engaging member 34 each engage the uppermost of the three detent formations in the form of barbs 42 on the cap 38. The uppermost barb 42 as shown in FIGS. 1A to 1F is the narrowest, the adjacent middle barb 42 is wider than the uppermost barb 42, and the lowermost barb 42 is wider than the middle barb 42.

In FIG. 1B the thickness of the glazing member 30A, 30B is of an intermediate size and, therefore, the outwardly extending portions 36A, 36B engage the middle of the three barbs 42. In FIG. 1C, the glazings 30A, 30B are of a thicker cross-section and, therefore, the outwardly extending portions 36A, 36B of the second cap engaging member 34 engage the lower most barbs 42.

It can thus be seen, that the glazing bar 12 can be used to hold different thicknesses of glazing 30A, 30B.

Figure 1D:
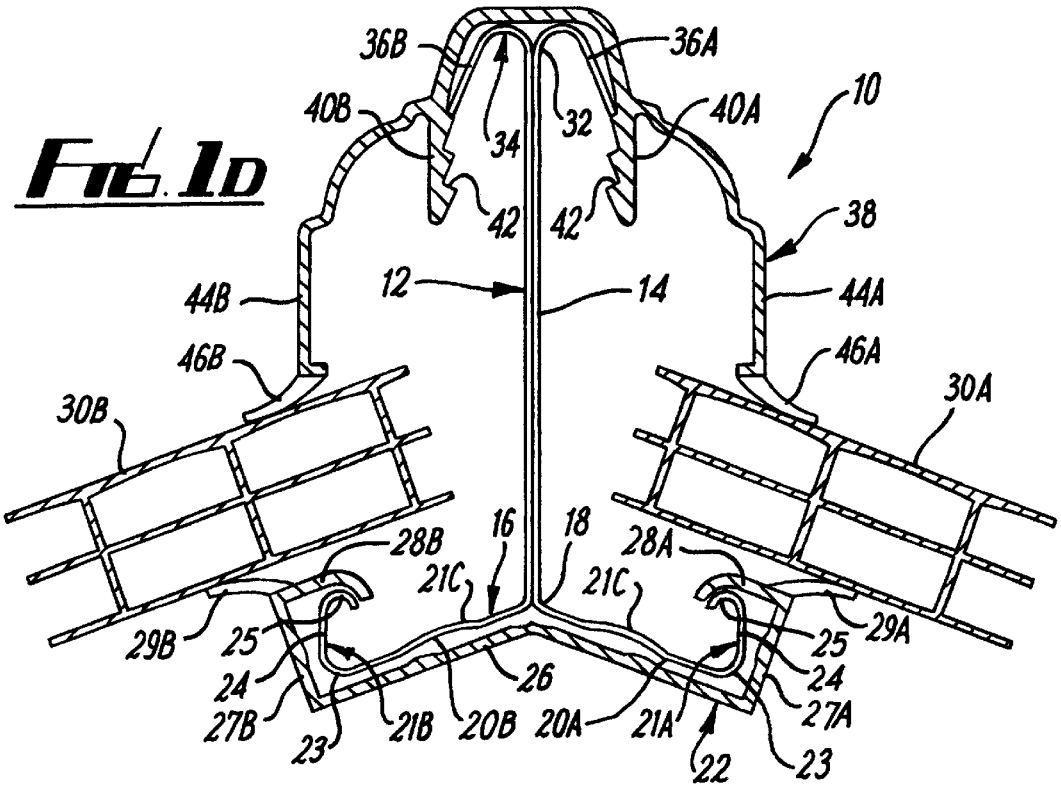
Figure 1E:
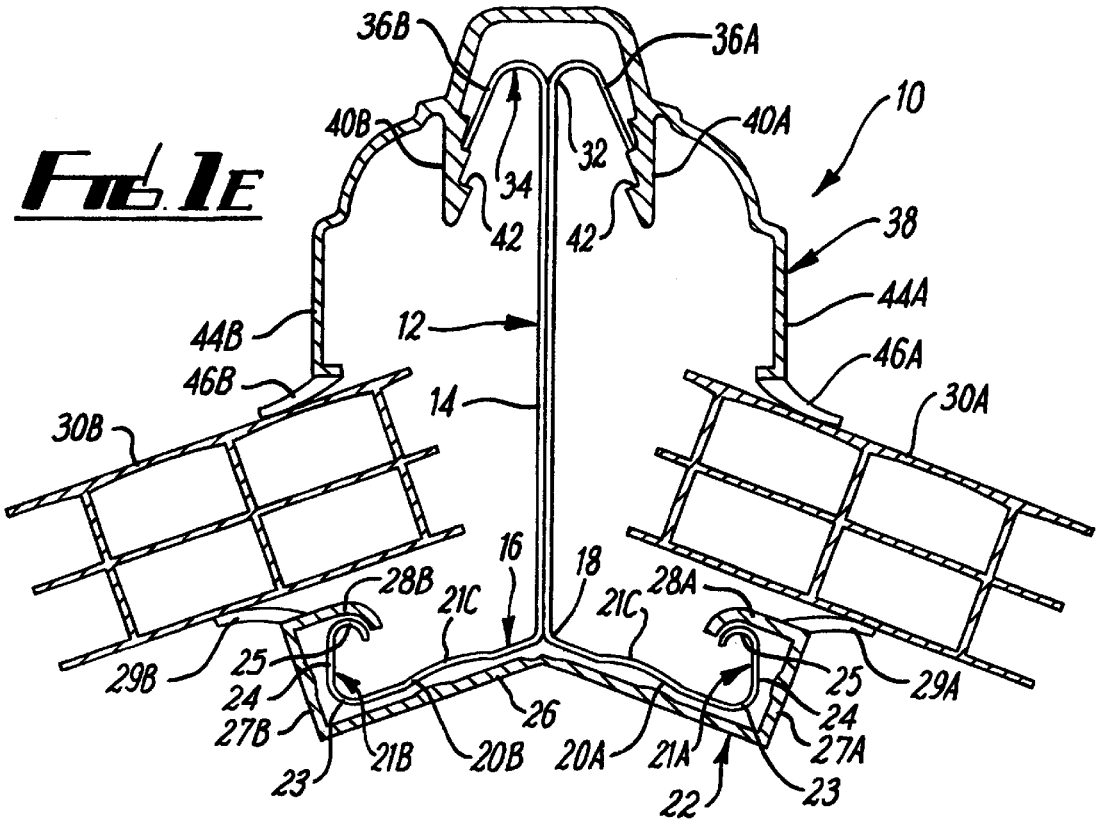
Figure 1F:
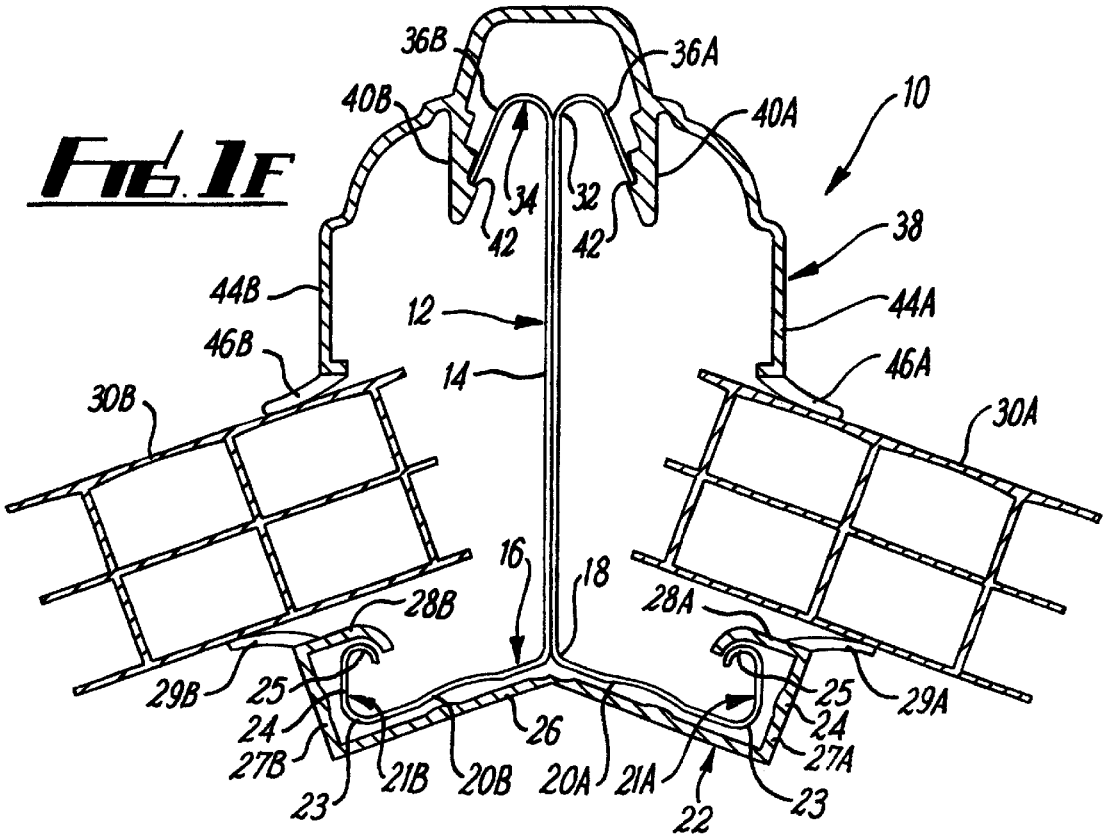

The assemblies as shown in FIGS. 1A to 1C form flat roofs. In FIGS. 1D to 1F there are shown the same arrangement as in FIG. 1A to 1B, but in FIGS. 1D to 1F, the roof is a hipped roof with the glazings 30A, 30B extending at an angle to the horizontal to suit the desired pitch, for example 30°. In addition, as can be seen, the lower cap member 22 is in a deformed configuration such that the base 26 has a profile in the shape of an upside-down V. All the features in FIGS. 1D to 1F are provided with the same reference numerals as in FIGS. 1A to 1B. As with FIGS. 1A to 1B, three different thicknesses of glazing 30A, 30B can be used. In FIG. 1D, the glazings 30A, 30B are of a narrow thickness, in FIG. 1E, the glazings 30A, 30B are of an intermediate thickness, and in FIG. 1F, the glazings 30A, 30B are of a wide thickness.

At a central region of each of the outwardly extending portions 20A, 20B there is provided a respective raised portion 21C through which a bolt can be inserted to secure the glazing bar to another member, for example an eaves beam, a ridge beam or a wall plate. The angle at which the bolt extends through the outwardly extending portions 20A, 20B, will depend upon the angle of the base 26 to the outwardly extending portions. The provision of the raised portion 21C allows the head of the bolt to be arranged approximately tangentially to at least a part of the outwardly extending portions 20A, 20B.

Figure 1G:
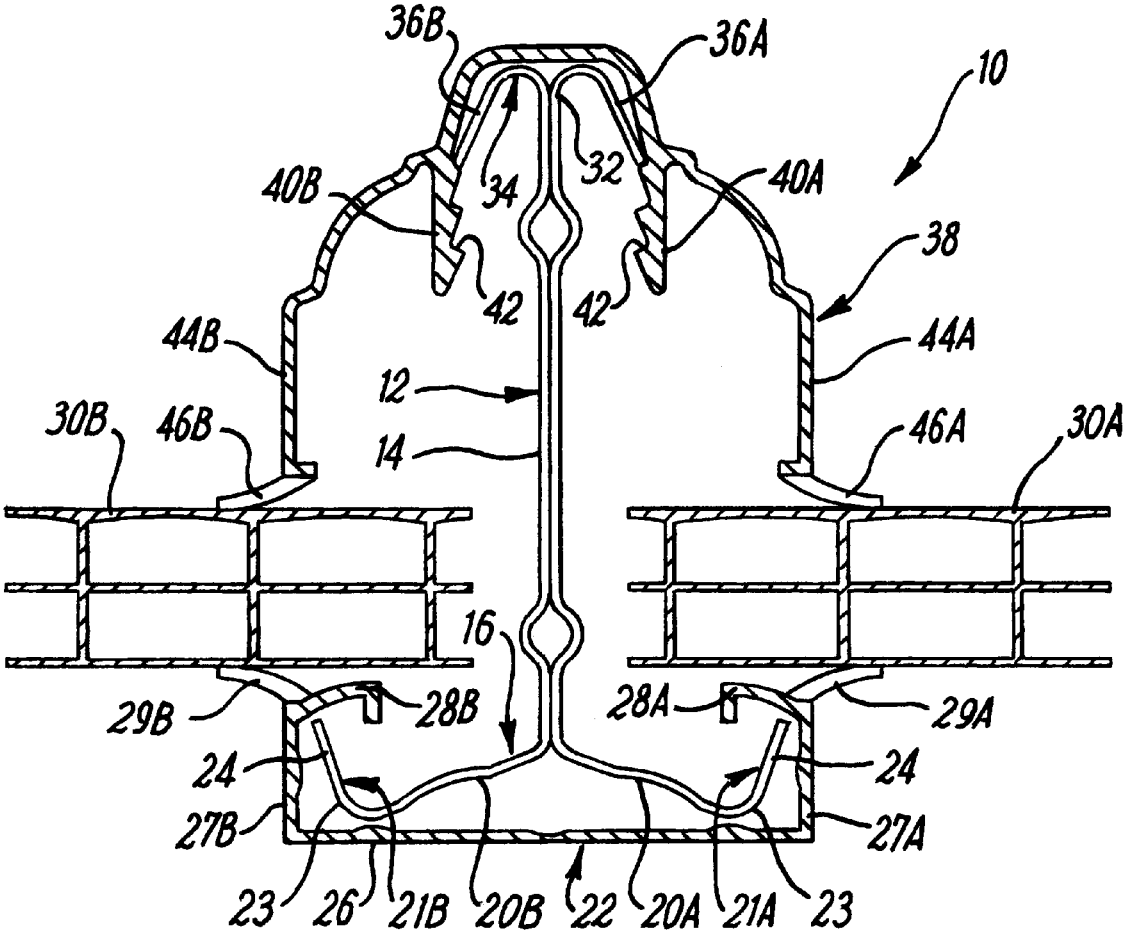
FIG. 1G is a cross-sectional end view of a further embodiment of a rafter arrangement.

FIG. 1G shows a further embodiment of the rafter arrangement 10 which includes a glazing bar 12. The embodiment shown in FIG. 1G includes many of the features of the embodiment shown in FIGS. 1A to 1F, and these have been designated with the same reference numeral.

The rafter arrangement 10 shown in FIG. 1G differs from the arrangement 10 in FIGS. 1A to 1F in that the inwardly curving portion 23 of the embodiment shown in FIGS. 1A to 1F is omitted, and the securing portions 21A, 21B terminate at the end of the upwardly extending straight portion 24.

A further difference is that the support member 14 is provided with screw ports 50, 52 to receive screws to secure an end member (not shown) or other component to the end of the glazing bar 12.

Although only one configuration of rafter arrangement 10 has been shown in connection with the glazing bar 12 in FIG. 1G, (i.e. a configuration similar to FIG. 1A) it will be appreciated that other configurations of the rafter arrangement 10, for example the configurations shown in FIGS. 1B to 1F, could also be formed using the glazing bar 12 shown in FIG. 1*a*.

Figure 2:
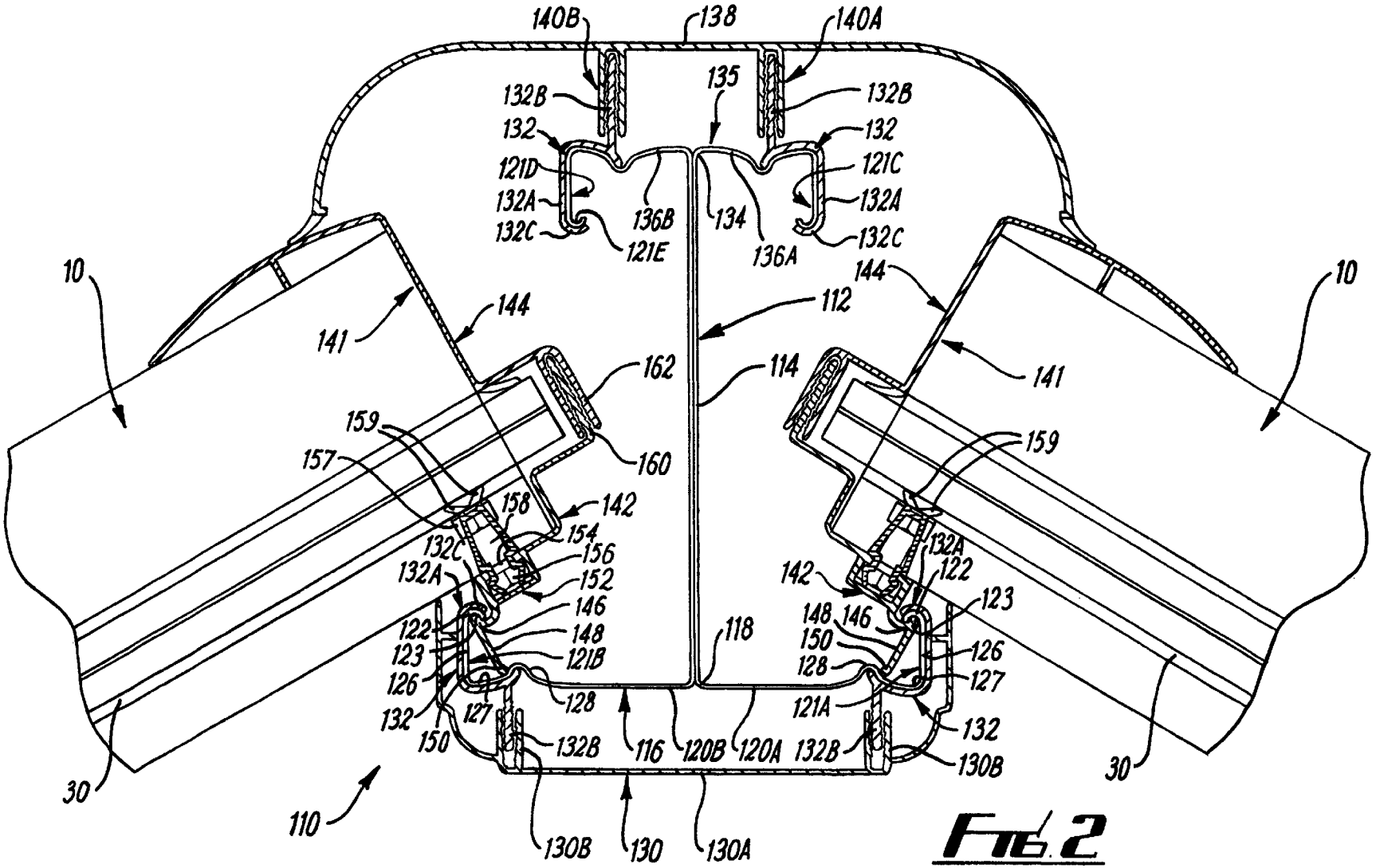
FIG. 2 is a cross-sectional profile view of a beam arrangement.

Referring to FIG. 2, there is shown a first embodiment of a ridge assembly 110 of a conservatory having a hipped roof. The ridge assembly supports two rafter assemblies 10 having glazing 30 on opposite sides of the ridge assembly 110 and comprises a beam member 112 which comprises a main support member 114 having provided thereon carrying means 116 at the lower edge region 118 of the support member 114. The beam member 112 is preferably formed of a steel material and may be manufactured by rolling. The beam member 112 may alternatively be formed of any other suitable material, for example aluminium.

The carrying means 116 comprises two outwardly extending rafter support members 120A, 120B extending on opposite sides of the main support member 114. At the outer edge region of the outwardly extending members 120A, 120B, there is provided respective securing means 121A, 121B. Each of the securing means 121A, 121B comprises a section 122 defining a recess 123 to receive an pivot portion 146 of a first capping member 142. Extending downwardly from the curved portion 122 there is a provided a straight section 126 which extends to a further curved portion 127. The further curved portion 127 extends inwardly from the straight section 126 to a stop member 128.

The pivot portion 146 of the first capping member 142 has a limb member 148 extending therefrom which, when the pivot portion 146 is received in the recess 123, engages the further curved portion 127. This allows pivotal movement of the limb member 148 about the pivot portion 146 thereby allowing each rafter assembly 10 to be arranged at a desired angle.

A cap member 130 is mounted on the securing portions 121A, 121B via connecting members 132 on each of the securing portions 121A, 121B. A plurality of connecting members 132 are provided along the length of each of the securing portions 121A, 121B. Adjacent connecting members 132 are spaced from each other on their respective securing portions 121A, 121B. If desired, alternatively a single connecting member 132 could extend the length of the respective securing portions 121A, 121B. Each connecting member 132 comprises curved portions 132A which correspond in configuration to the securing portions 121A, 121B. A barbed member 132B extends from the curved portion 132A. The barbed member 132B is provided with barbs on the outside thereof. The cap member 130 comprises a main body portion 130A and a pair of inwardly extending barbed members 130B on the main body portion 130A. The barbed members 130B are provided with barbs on the inside thereof and receive and co-operate with the barbed members 132B. The barbed members 130B, 132B are provided with a plurality of mating barbs and are micro-adjustable with respect to each other. The purpose of the micro-adjustment is to accommodate any desired angle of the rafters 10. This ensures that the outer edges of the cap member 130 abut the rafters 10 at any angle of the rafter assemblies 10 to the horizontal.

At the opposite edge 134 of the support member 114 there is provided a further carrying means 135 having two outwardly extending members 136A, 136B which comprise, at opposite ends thereof, further securing carrying 121C, 121D. As can be seen from FIG. 2, the further securing portions 121C, 121D are upside-down relative to the securing portions 121A, 121B, but comprise the same features as securing portions 121A, 121B. Arranged around the outside of the securing portions 121C, 121D are connecting members 132 which are the same as the connecting members 132 connected to the securing portions 121A, 121B. The connecting members 132 are connected to a cap member 138 via inwardly extending barbed members 140A, 140B which receive and co-operate with the barbed members 132B on the connecting members 132. The barbed members 140A and 140B are provided with a plurality of inwardly extending barbs to mate with the outwardly extending barbs on the barbed members 132B. This renders the positions of the barbed members 132B, 140A and 140B micro-adjustable with respect to each other, whereby the edges of the cap member 138 can be adjusted up and down to accommodate any suitable thickness of glazing in the rafters 10.

Each securing portion 121C, 121D includes a curved end member 121E. The connecting members 132 have corresponding curved members 132C and each is initially fitted onto the curved end member 121E of the respective securing portion 121C, 121D before being snapped into the position, as shown, around the respective securing portion 121C, 121D. The securing portions 121A, 121B at the respective outwardly extending portions 120A, 120B are also provided with similar curved end members 121E and the connecting members 132 are similarly provided with curved members 132C which are fitted together in the same way.

A securing member in the form of capping means 141 is provided on the end of the glazing bar of the rafter assemblies 10. Each capping means 140 comprises a first capping member 142 and a second capping member 144.

The first capping member 142 comprises a pivot portion 146, limb member 148 extending downwardly from the pivot portion 146. The limb member 148 has an end 150 spaced from the pivot portion 146. The limb member 148 is pivotally movable between the position shown in FIG. 2 in which the end 150 engages the stop member 128, which prevents movement therebeyond, and the position in which the limb member engages the straight section 126 of the respective securing portions 121A and 121B.

The first capping member 142 also includes holding means in the form of a channel member 152 defining an open sided channel 154 to receive the head 156 of a bolt 158. The bolt 158 can be slid along the length of the channel 154. The shank of the bolt 158 is received through a part of the glazing bar of the rafter assembly 10. In one embodiment, where the glazing bar of the rafter assembly 10 is the same as the glazing bars shown in FIGS. 1A to 1G the shank of the bolt 158 is received through an aperture in the outwardly extending portions 20A or 20B. A nut is then threadably tightened onto the shank of the bolt 158. Also held in the channel 154 is a sealing member 157 having sealing portions 159 which seal against the underside of the glazing 30.

The first capping member 142 is adjustably mounted on the second capping member 144 by adjustment means comprising a first adjustment member 160 on the first capping member 142 and a second adjustment member 162 on the second capping member 144. The first adjustment member 160 comprises a planar member having outwardly extending detents on each side of the planar member. The second adjustment member 162 comprises a pair of generally parallel planar members which can receive therebetween the first adjustment means 160. Each of the planar members of the second adjustment means 162 comprises inwardly extending detents which can cooperate with the outwardly extending detents on the first adjustment means 162. Thus, the height of the capping means 141 can be adjusted to accommodate different heights of glazing bar in the rafter assembly 10.

Figure 3:
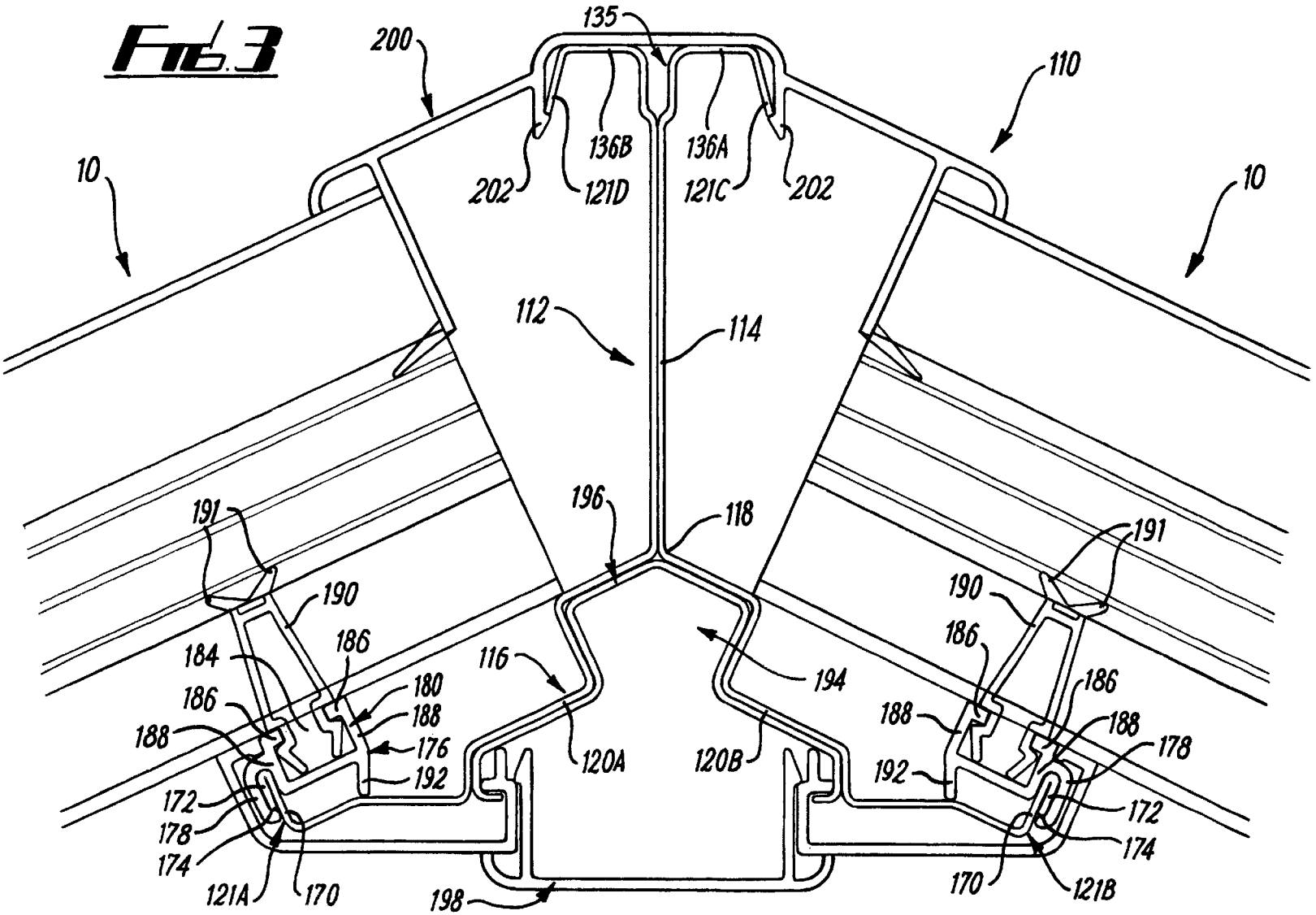
FIGS. 3 and 4 are cross-sectional end views of two versions of a further embodiment of a beam arrangement.
Figure 4:
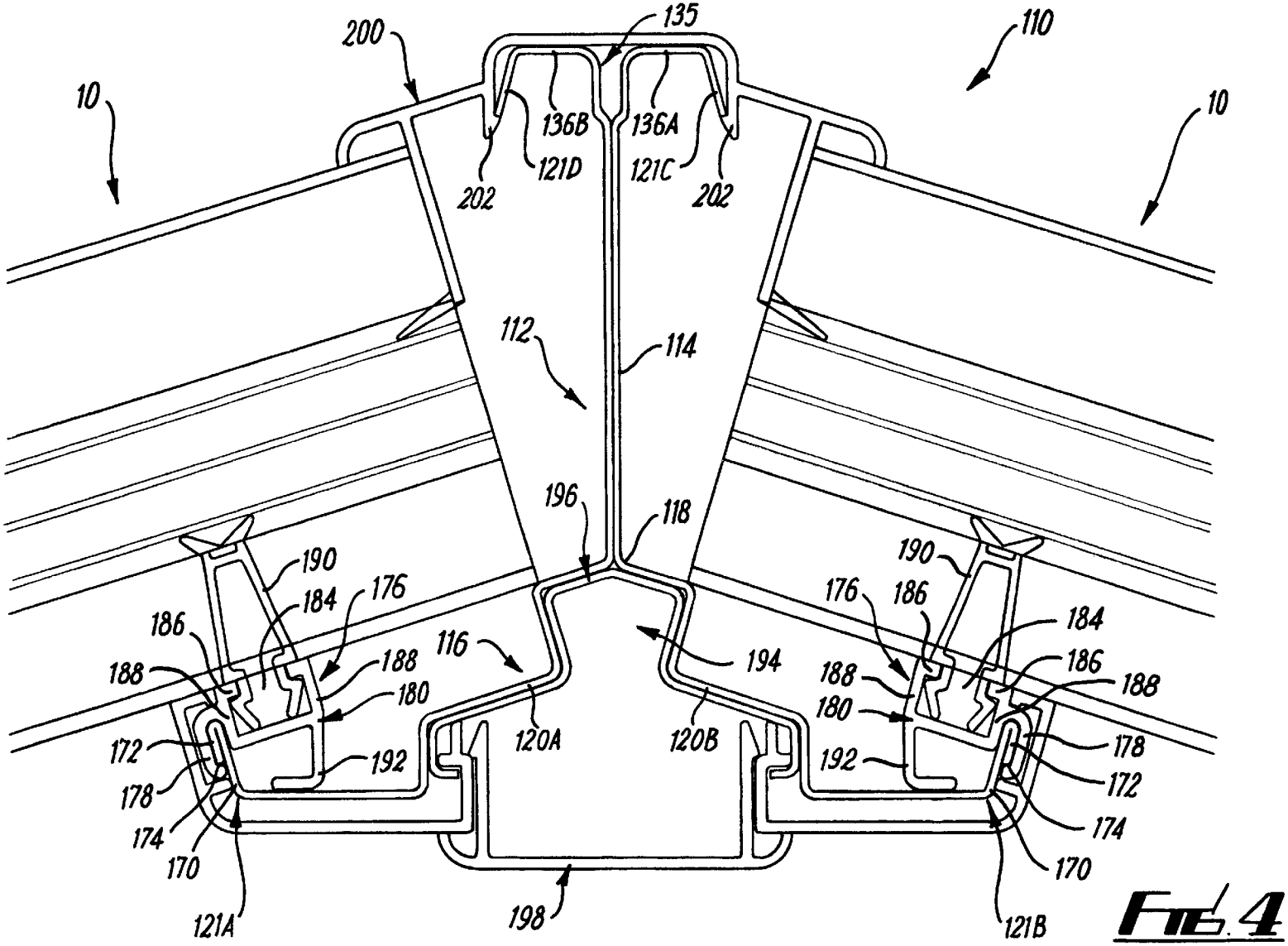

Referring to FIGS. 3 and 4, there is shown two versions of a second embodiment of a ridge assembly 110, which comprises generally the same features as described above with reference to FIG. 2, and these features have been designated with the same reference numerals. In the second embodiment, the securing means 121A, 121B comprises a first upstanding member 170, and a second member 172 folded back across the first member 170 such that the second member 172 lies in face-to-face contact with the first member 170, and forms a step 174 therewith. A securing member 176 is fastened to the securing means 121A by a securing formation in the form of a downwardly extending member 178 which engages underneath the step 174. The securing member 176 comprises a fastening portion in the form of a channel member 180 defining a channel 182 having an open side 184. A pair of inwardly directed flanges 186 extend from opposite side walls 188 part way across the open side 184. The flanges 186 secure in the channel a sealing member 190 having sealing portions 191 which seal against glazing 30 of a rafter assembly 10. The sealing member 190 is generally the same as the sealing member 157 described above with the reference to FIG. 2. Also held within the channel 182 is a bolt (not shown for reasons of clarity) in the same way as the bolt 158 is held within the channel 154 of the embodiment shown in FIG. 1. Similarly, the bolt of the embodiment shown in FIGS. 3 and 4 is secured to the rafter assembly 10 in the same way as the bolt 158 shown in FIG. 2.

A stop member 192 extends from the channel member 180 to engage the outwardly extending members 120A, 120B.

As can be seen, the outwardly extending members 120A, 120B is shaped in the vicinity of the main support member 114 to define an aperture 194 for holding a cap engaging member 196. A capping arrangement 198 is held by the cap engaging member 196, as shown.

At the upper region of the beam member 112, a cap 200 is held by the securing means 121C, 121D by triangular detents 202 which engage the securing means 121C, 121D.

FIG. 4 shows a version of the embodiment shown in FIG. 3, but which differs only in that the outer regions of the outwardly extending members 120A, 120B of FIG. 3 extend downwardly, whereas, in FIG. 4, they are generally planar. This allows the rafter assemblies 10 in FIG. 3 to extend at a steeper angle from the beam member 112 than in FIG. 4.

Figure 5:
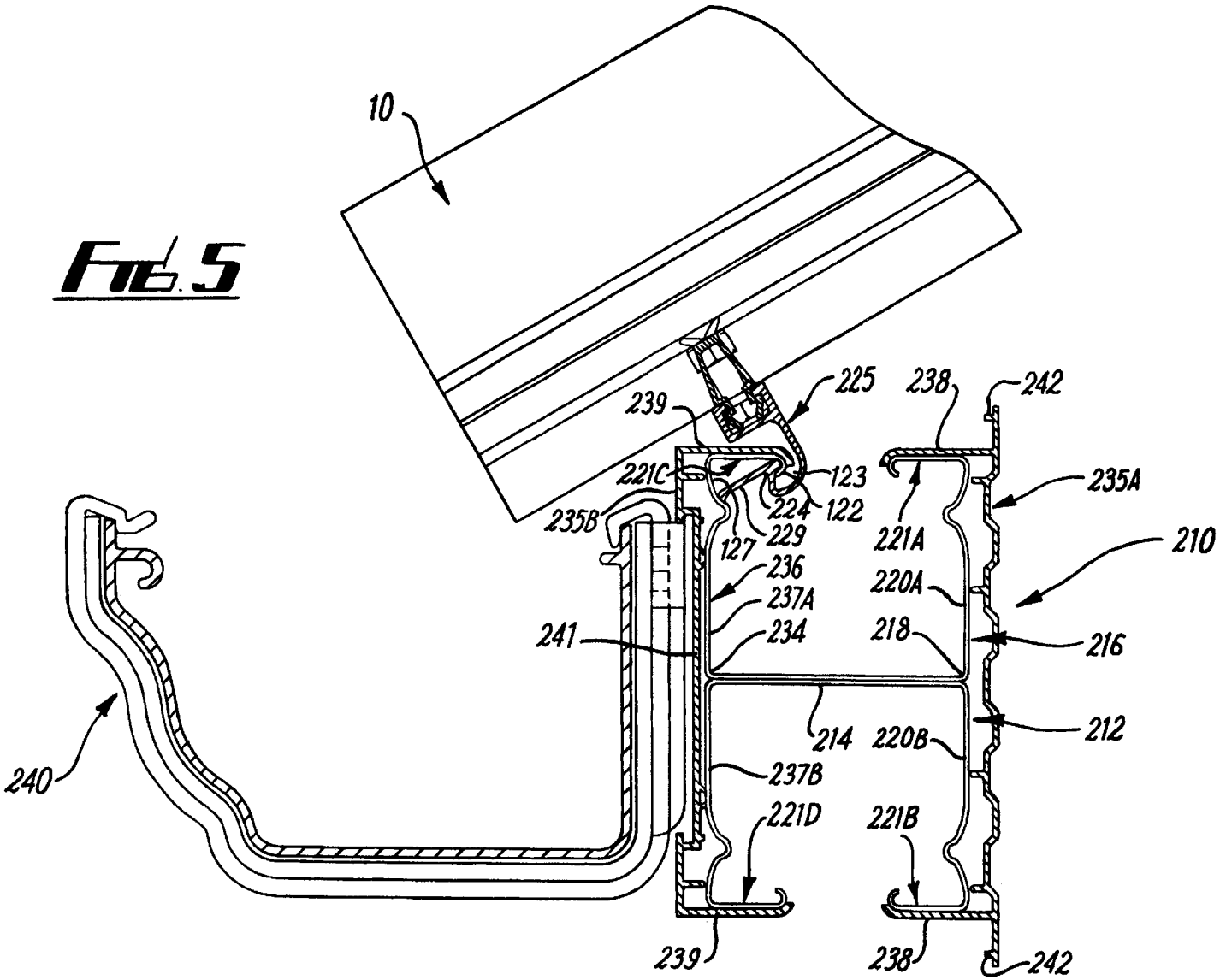
FIG. 5 is a cross-sectional end view of an eaves assembly.

Referring to FIG. 5, there is shown an eaves assembly 210. The eaves member 210 comprises a beam member 212, which is preferably formed of a steel material, or any other suitable material, for example aluminium. The beam member 212 may be formed by rolling and is similar in construction to the beam member 112 having a central main support member 214, and securing means 216 extending from edge region 218 of the support member 214. The securing means 216 comprises opposite outwardly extending members 220A, 220B having at their free ends securing portions 221A, 221B. The securing portions 221A, 221B are the same as the securing portions 121A, 121B and have the same features which are provided with the same reference numerals.

At the opposite end region 234 of the support member 214 of the end region 218, there is provided a further securing means 236 comprising opposite outwardly extending members 237A, 237B which are also provided with respective securing portions 221C, 221D. As can be seen, only the securing portion 221C is used to secure the rafter 10. A connecting member 225, formed of aluminium, extends from the rafter 10 and comprises an elbow portion 224 received in the recess 123 defined by the curved region 122 of the securing portion 221C. A limb member 229 extends from the elbow portion 224 and engages at its opposite edge with the further curved portion 127.

As with the securing portions 121A, 121B, the limb member 229 can be pivoted about the recess 123 to any desired angle against the further curved portion 127, to accommodate any angle of the rafter 10. Each of the securing portions 221A, 221B, 221C and 221D also secures to the beam member 212 a respective cover plate 235A or 235B. Each of the cover plates 235A, 235B has respective connecting members 238, 239 to engage the outside of the securing portions 221A, 221B, 221C and 221D. A guttering 240 is attached lengthwise to the cover plate 235B at a recess 241. The recess 241 can receive clip means (not shown) to fix the guttering 240 to the cover plate 235B. The cover plate 235A comprises inwardly extending projections 242 to engage a corresponding formation on a capping member (not shown) at a corner between adjacent cover plates 235A.

Figure 6A:
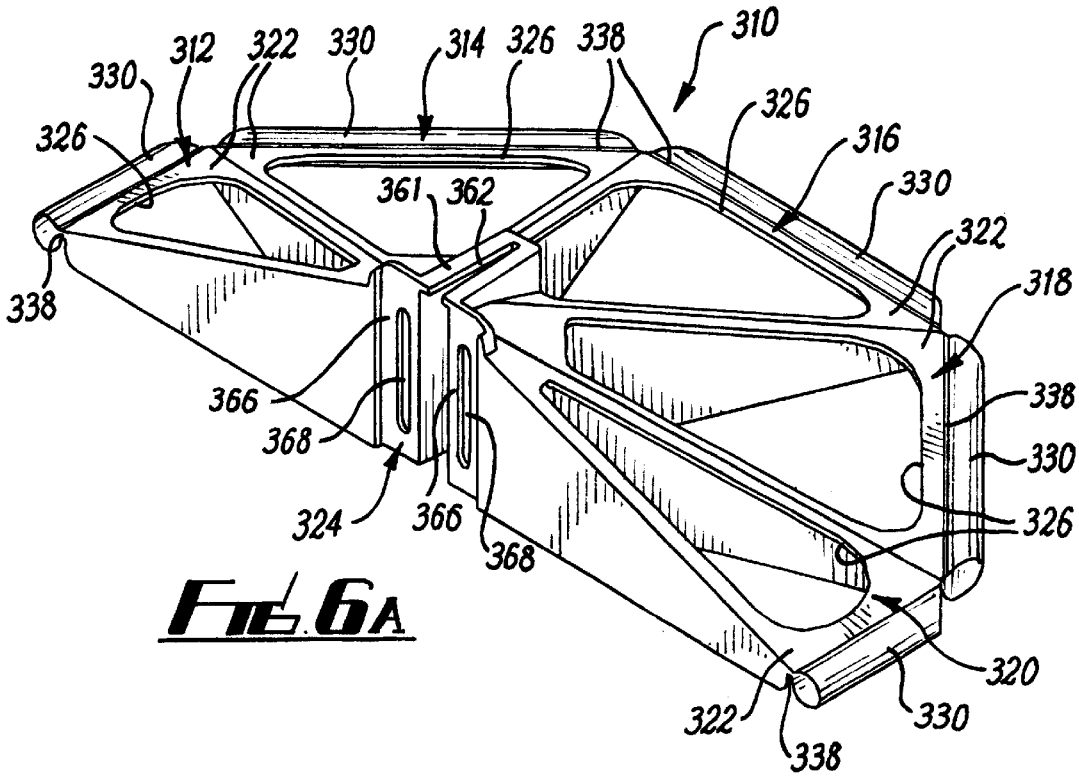
FIGS. 6A and 6B are respectively perspective views in opposite directions of a ridge end.
Figure 6B:
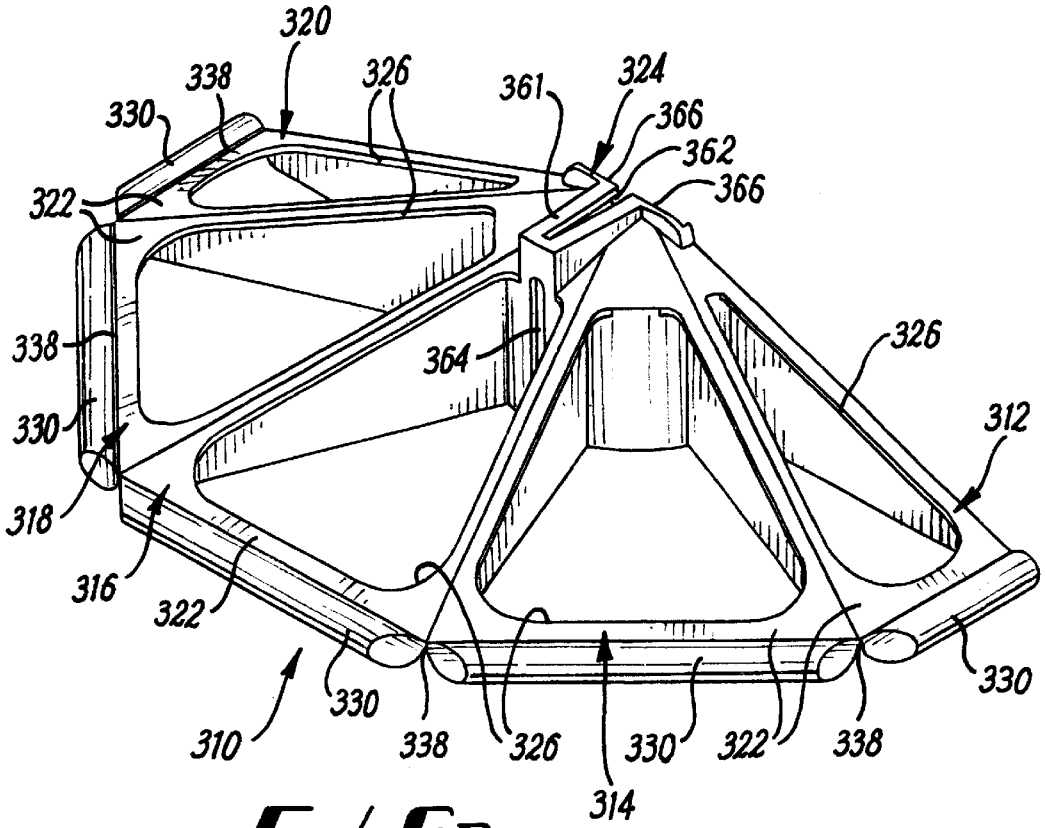

FIGS. 6A and 6B, and 7 to 10 show a ridge end arrangement. FIGS. 6A and 6B show respectively rear and front perspective views of an example of a ridge end member 310, which is formed of a suitable material such as moulded plastics material, for example a mineral filled nylon, of a cast metal, for example zinc or aluminium alloy and comprises a plurality of segments 312, 314, 316, 318, 320 extending from a hub member 324. Three of the segments namely segments 314, 316 and 318 are full segments, each occupying approximately a quarter of the space occupied by all the segments, whereas each of the segments 312, 320 occupies half the space of the full segments 314, 316 and 318.

Each of these segments 312 to 320 is substantially triangular in configuration and comprises a top portion 322 extending from the top of the hub member 324. As can be seen, the top portion 322 of each segment defines an aperture 326 therein which is formed in each upper portion 322 for weight and cost saving.

At the opposite edge of each of the segments from the hub member 324, there is provided a substantially cylindrical connecting member 330 to which can be connected an appropriate sleeve 332 (see FIG. 7) to enable a rafter to be attached thereto.

The ridge end member 310 is so configured in the embodiment described that the cylindrical connecting members 330 are arranged in the finished conservatory substantially parallel to corresponding eaves of the conservatory. Clearly, it will be appreciated by the skilled person that the ridge end member 310 can be of any suitable configuration, providing the arrangement of the cylindrical connecting members 330 correspond to the desired arrangement of the eaves of the conservatory.

Figure 7:
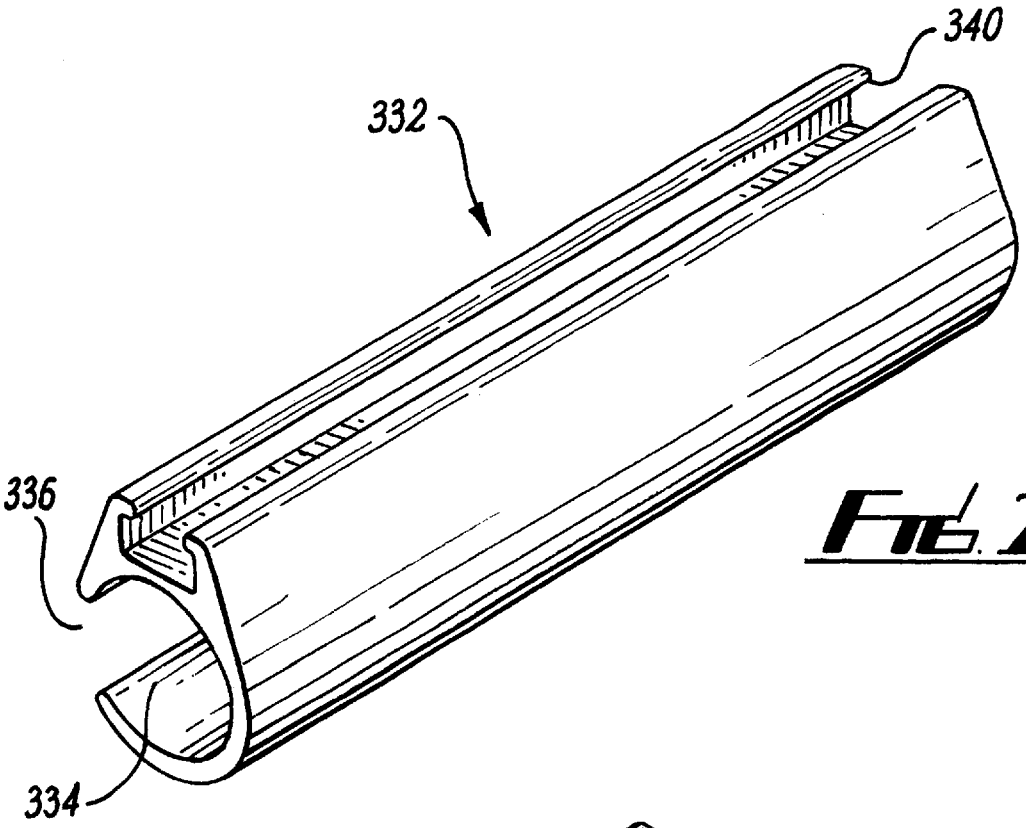
FIG. 7 is a perspective view of a connecting member for use with the ridge end shown in FIGS. 4A and 4B.

Referring to FIG. 7, the sleeve 332 is formed of a suitable material such as a material from which the ridge end member can be formed or an aluminium extrusion and defines a substantially cylindrical bore 334 therethrough which has an open edge 336 along part of the periphery of the bore to enable the sleeve 332 to be slid onto one of the connecting members 330.

The connecting members 330 are connected to the segments 312 to 320 via a thin strip 338, and the open edge 336 of each sleeve 332 is fitted over the strip 338 when arranged on the respective cylindrical connecting member 330.

The ends of the cylindrical connecting member 330 are shaped so that the sleeves 332 can be slid past the respective ends onto the adjacent cylindrical connecting member. Each end generally lies substantially parallel to and in line with the adjacent edge of the adjacent segment.

The open edge 336 of each cylindrical bore 334 is wider than the respective strip 338 which enables the sleeve 332 to be pivoted about the respective connecting cylinders 330 to enable the rafter mounted thereon (as will be explained below) to extend from the ridge end member 310 at a desired angle.

At the top of each of the sleeves 330 there is provided an inverted T-shaped groove 340 which can receive an appropriate part of a connecting member, for example the head of a bolt to connect the rafter thereto.

It will be appreciated that when the ridge end member 310 is in use, and the sleeves 332 fitted thereto, the sleeves 332 will be mitred to allow them to fit together and the hip rafter can extend at the mitred joint over adjacent sleeves 332.

Thus, a hip rafter can extend from a mitred joint defined by two adjacent sleeves 332 and is provided with two bolts (not shown) to connect the rafter to a respective one of the adjacent sleeves 332. Glazing bars can extend from central regions of the sleeves at any desired angle by rotation of the sleeve.

Figure 8:
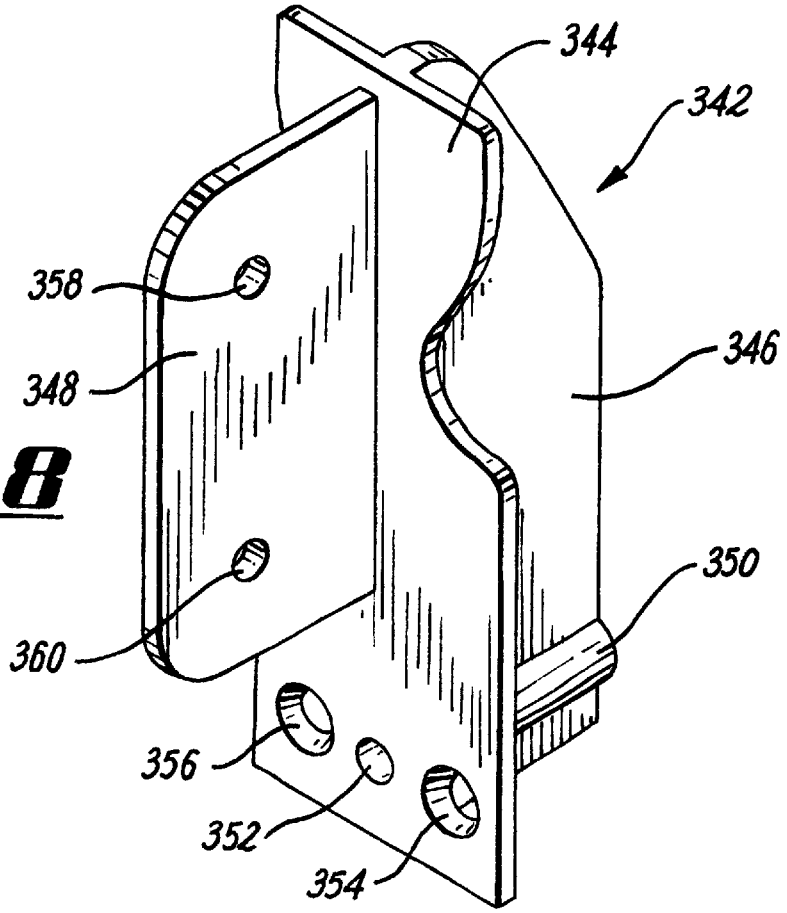
FIG. 8 is a perspective view of a beam attachment member for use with the ridge end shown in FIGS. 4A and 4B.

The hub member 324 is adapted to co-operate with a connecting device in the form of a beam attachment member 342 shown in FIG. 8. The beam attachment member 342 comprises a centre support plate 344 on one side of which extends a first connecting projection 346, and on the other side there extends in the opposite direction a second connecting projection 348. The beam attachment member 342 is formed of a suitable material, for example a material from which the ridge end member can be formed.

The first connecting projection 346 extends substantially the length of the plate 344, and is provided toward its lower end with a cylindrical member 350 defining a bore 352 therethrough.

The first connecting projection 346 extends centrally of the support plate 344, and the second connecting projection 348 is slightly off-set from the first connecting projection 346. Two countersunk apertures 354, 356 are defined in the support plate 344 and are to accommodate screws or bolts extended therethrough to be fitted into appropriate slots in the hub member 324 on the ridge end 310.

The second connecting projection is provided with two apertures 358, 360 to enable bolts to be inserted therethrough so it can be bolted to a ridge beam.

The hub member 324 has a T-shaped profile and defines along its stem 361 a V-shaped recess 362 (see FIGS. 6A and 6B) to receive the first connecting projection 346. At the end of the stem 361 of the T is a slot 364 through which a bolt can be passed to be threadably received in the bored cylinder 350 of the first connecting projection 346.

The arms 366 of the T are similarly provided with slots 368 which can receive bolts extending through the countersunk holes 356, 354 in the plate 344. Thus, the position of the beam attachment member 342 on the hub member 324 can be adjusted for height, to accommodate any desired angular variation of the hip rafters extending from the joints between adjacent sleeves, and the glazing bars extending from the central region of the respective sleeves.

Figure 9:
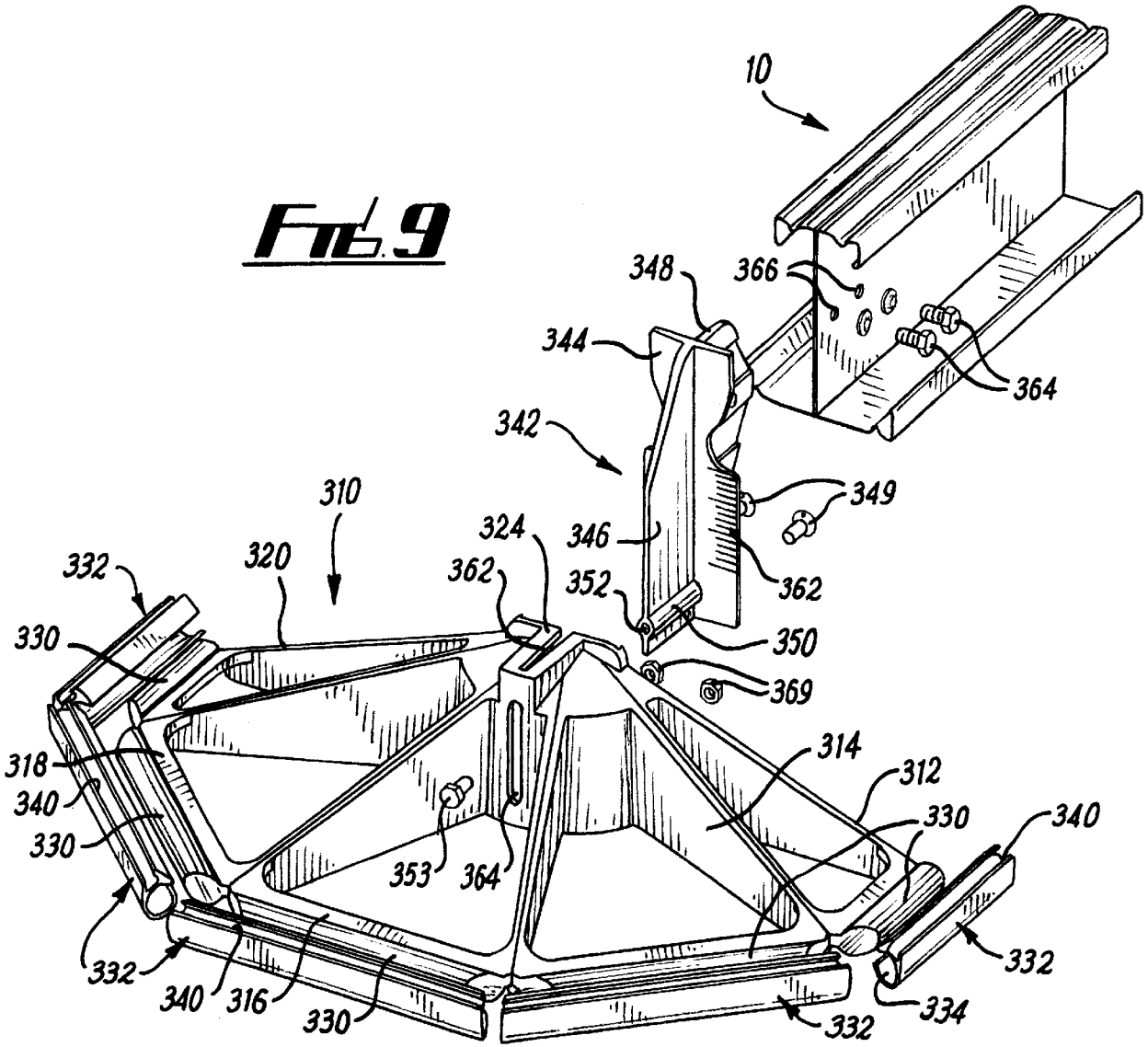
FIGS. 9 and 10 show a ridge end arrangement and the way in which the components thereof are secured together.
Figure 10:
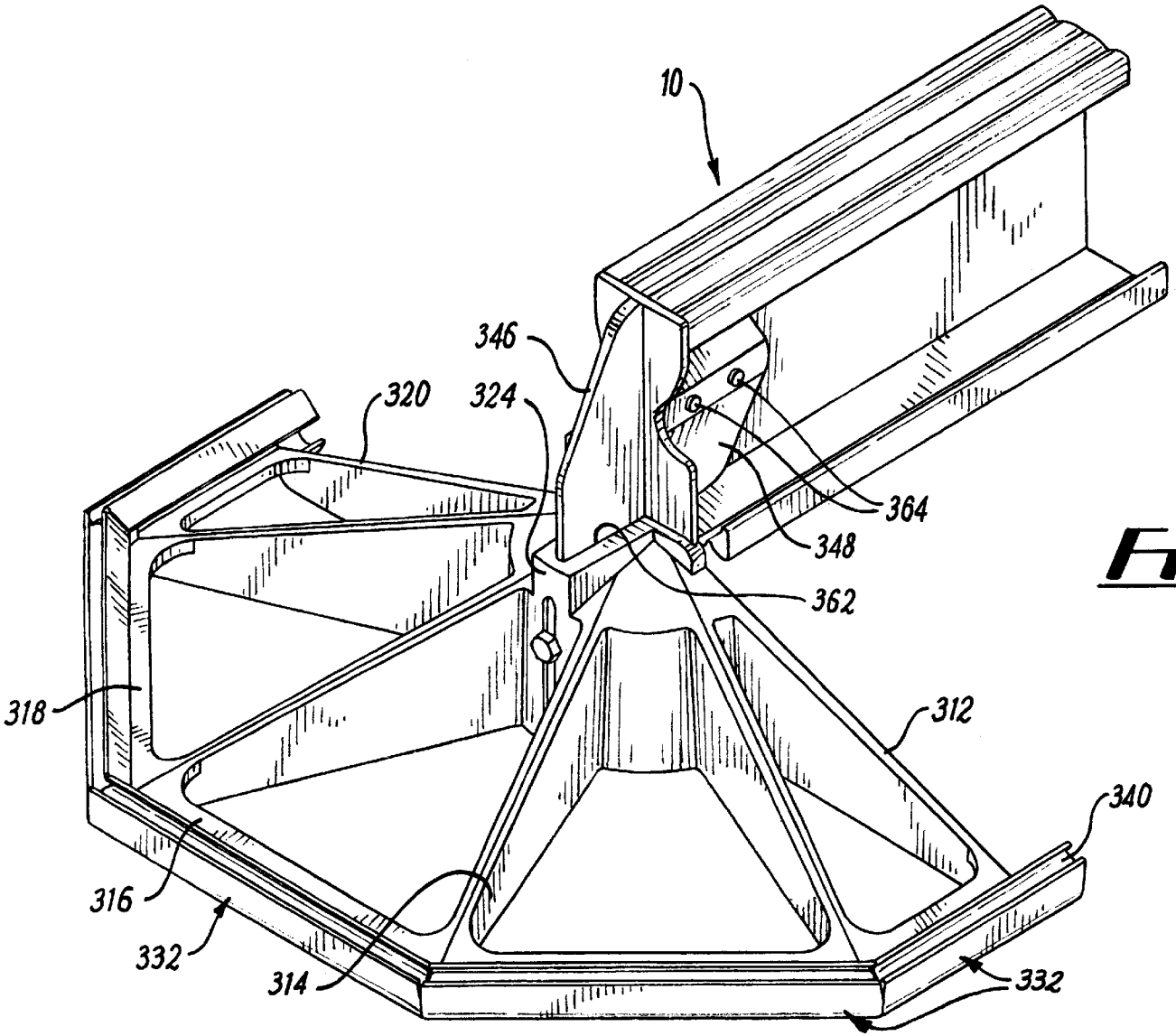

Referring to FIGS. 9 and 10 there is shown the ridge end arrangement and the way in which the components of the arrangement are connected together. As shown, the sleeves 332 are slid over the respective cylindrical member 330. The first connecting projection 346 of the beam attachment member 342 is in the form of a trapezoidal substantially flat plate, which is received in the recess 362. The bore 352 in the cylindrical member 350 is aligned with the slot 364. The bore 352 is preferably provided with threads, and the shank of a bolt 352 passes through the slot 364 to threadably engage the bore 352.

The shanks of screws 349 pass through the apertures 354 (not visible in FIG. 9), 356 in the centre plate 344 and through the slots 368 (not visible in FIG. 9) to be threadably secured to nuts 369.

Thus, the beam attachment member 342 is secured to the ridge end member by the screws 349 and the bolt 353.

Indicia 362 are provided on the plate 344 and indicate the level at which the top of the hub member 324 is to be secured to the beam attachment member 342. The indicia represent the angle to the horizontal at which the glazing bars extend from the ridge end member 310. Indicia higher up the centre support plate 344 indicate a shallower angle to the horizontal, whereas indicia lower down the centre plate 344 indicate a steeper angle to the horizontal.

Screws 364 are provided to secure the second connecting projection 348 to the glazing bar 10. The shanks of the screws 364 extend through the apertures in the second connecting projections 348 and through drilled apertures 366 in the glazing bar 10. The screws 364 are threadably secured to nuts (not visible) on the opposite side of the glazing bar 10. The second connecting projection 348 is in the form of a substantially planar plate.

As can be seen, the apertures in the second connecting projection are arranged generally horizontally, whereas the apertures 358, 360 in the second connecting projection 348 shown in FIG. 6 are arranged vertically. As will be appreciated, the precise orientation of the apertures in the second connecting projection 348 can be varied as desired.

Figure 11:
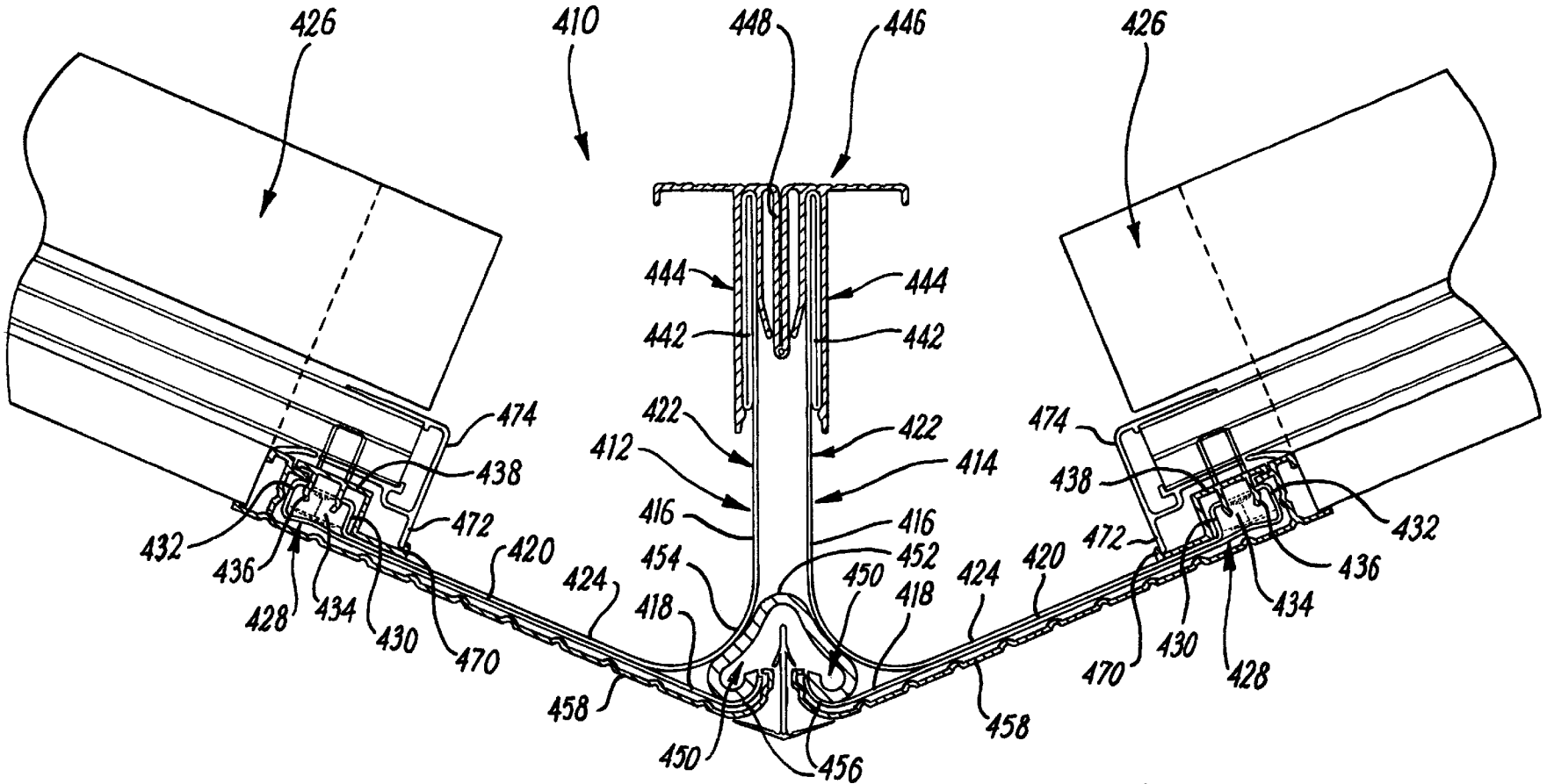
FIGS. 11 and 12 are end views of a valley rafter assembly in two positions.
Figure 12:
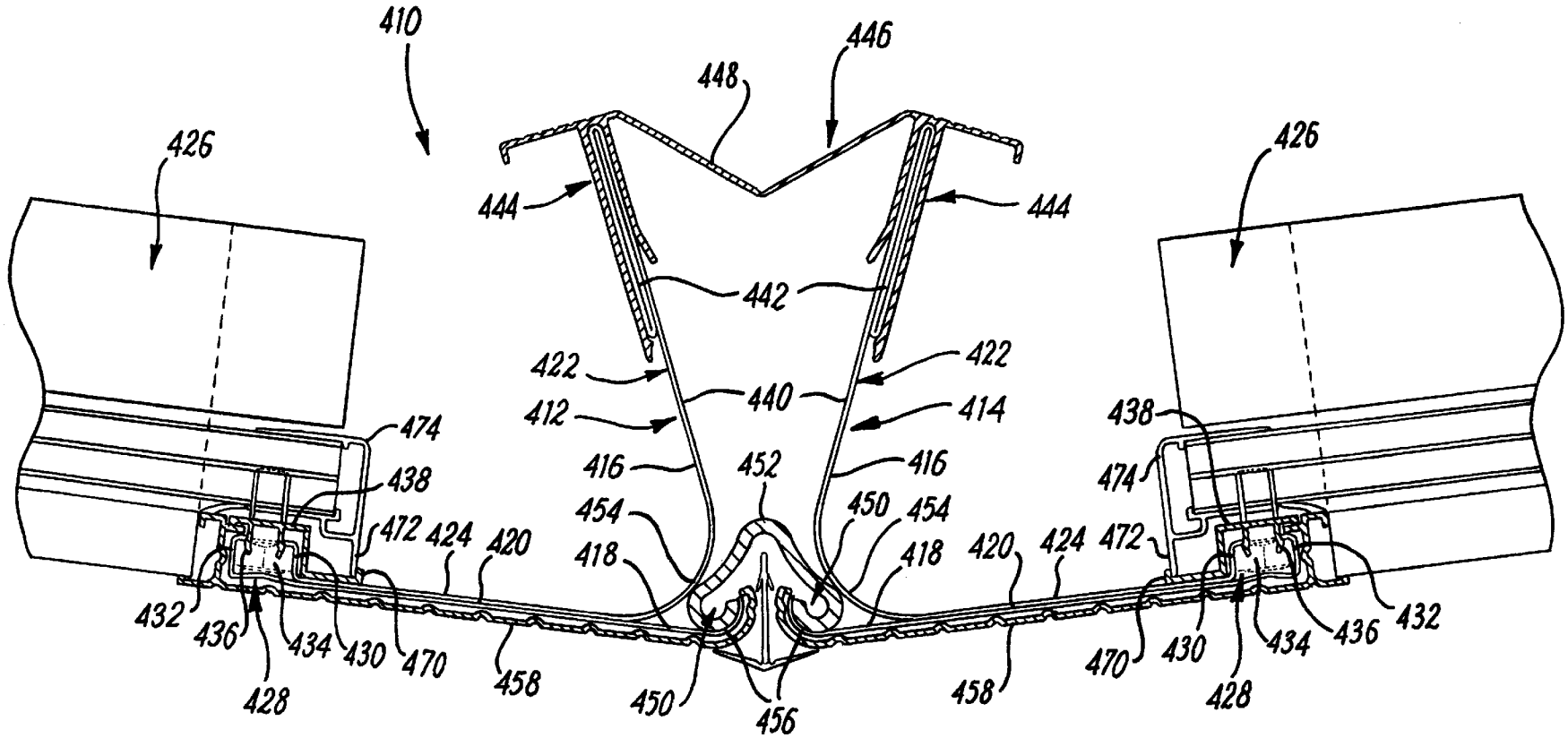

Referring to FIGS. 11 and 12, there is shown a valley rafter assembly 410. FIG. 9 shows the assembly 410 at the minimum angle between the two sides, and FIG. 10 shows the assembly 410 at the maximum angle between the two sides.

The valley rafter assembly 410 is generally intended for use in roofs, for example conservatory roofs which define a valley where two sections of the roof meet. The valley rafter assembly 410 comprises first and second wing members 412, 414 which are pivotally movable between a first, or minimum angle position shown in FIG. 11 and a second, or maximum angle position shown in FIG. 12. Each wing member 412 or 414 comprises first and second elements in the form of elongate metal strips 416, 418. The metal may be steel, and the strips 416, 418 are connected substantially along the whole of their length across part of their width. In FIGS. 11 and 12, the region at which the strips 416, 418 are secured together is designated 420.

The strips 416, 418 may be secured together by any suitable means known in the art, for example by a press joint, or welding.

Each of the wing members 412, 414 is formed of two portions, namely an upstanding section 422, and a lateral section 424. Each lateral section 424 is attached at its respective free end to a rafter assembly generally designated 426. The rafter assemblies 426 are secured to the lateral sections 424 at mounting formations 428 provided on the lateral section 424.

Each of the mounting formations 428 is formed from a first mounting portion 430 provided on the first strip 416, and a second mounting portion 432 provided on the second strip 418. The mounting portions 430, 432 are formed by appropriate bending, or rolling of the free end regions of the respective strips 416, 418.

As can be seen from FIGS. 11 and 12, the mounting formations 428 are in the form of generally open-topped channels having inwardly directed flanges, and can receive therein the head of a bolt 434 which can be used to secure the rafter assemblies 426 to the respective mounting formations 428. The shank of the bolt 434 passes through a cylinder 550 (not shown in FIG. 11 or 12) which forms part of a bracket 540 (not shown in FIG. 9 or 10). The construction and function of the bracket 540 is described below with reference to FIGS. 13 to 15. The mounting formations 428 can receive therein projections 436 of a holding member 438 to secure the holding member 438 to the mounting formation 428. The rafter assemblies 426 may be in the form of rafter arrangements 10 described earlier in the specification.

The holding member 438 includes an upstand 470 which engages a downwardly extending element 472 of an end cap 474 mounted on the glazing panel of the rafter assembly 426. The upstand 470 prevents slippage of the glazing panel towards the wing members 412, 414. The end cap 474 may be formed of a suitable material such as aluminium.

The upstanding portion 422 of each of the wing members 412, 414 is formed from the first strip 416 and comprises a first support section 440, and a second capping engaging sections 442.

The capping engaging section 442 comprises a plurality of folds. The end fold is arranged between the first and second folds. The cap engaging portion 442 of each of the wing members 412, 414 is received in respective correspondingly shaped receiving recesses 444 of a cap member 446 receiving recesses 444 of a cap member 446. As can be seen by comparing FIGS. 11 and 12, when the rafter assembly 410 is in its minimum angle position, as shown in FIG. 11, the foldable central section 448 is folded such that the two sides engage each other, whereas in FIG. 12, the two sides of the foldable central section are splayed apart.

Each of the wing members 412, 414 also includes a pivot receiving formation 450 arranged between the upstanding portion 422 and the lateral section 424. The pivot receiving formation 450 receives within it part of a pivot member 452. The respective pivot receiving portions 450 of each of the wing members 412, 414 receive a respective part on opposite sides of the pivot member 452.

The pivot receiving portion 450 is formed from a first pivot receiving portion 454 on the first strip 416. The first pivot receiving portion 454 is in the form of a curved part of the strip 416 between the upstanding portion 442 and the region of the strip 416 which forms the lateral section 424.

The pivot receiving formation 450 is also formed from an end portion 456 of the second strip 418, the portion 456 being shaped to receive the pivot member 452 and hold the pivot member 452 in the pivot receiving formation 450, to allow the wing members 412, 414 to pivot around the pivot member 452 to suit any angular variations in the pitch of either or both adjacent roof sections.

Respective lower capping members 458 are secured to the lateral section 424 by engaging at their opposite ends with the pivot receiving formation 450 and the mounting formation 428.

Figure 13:
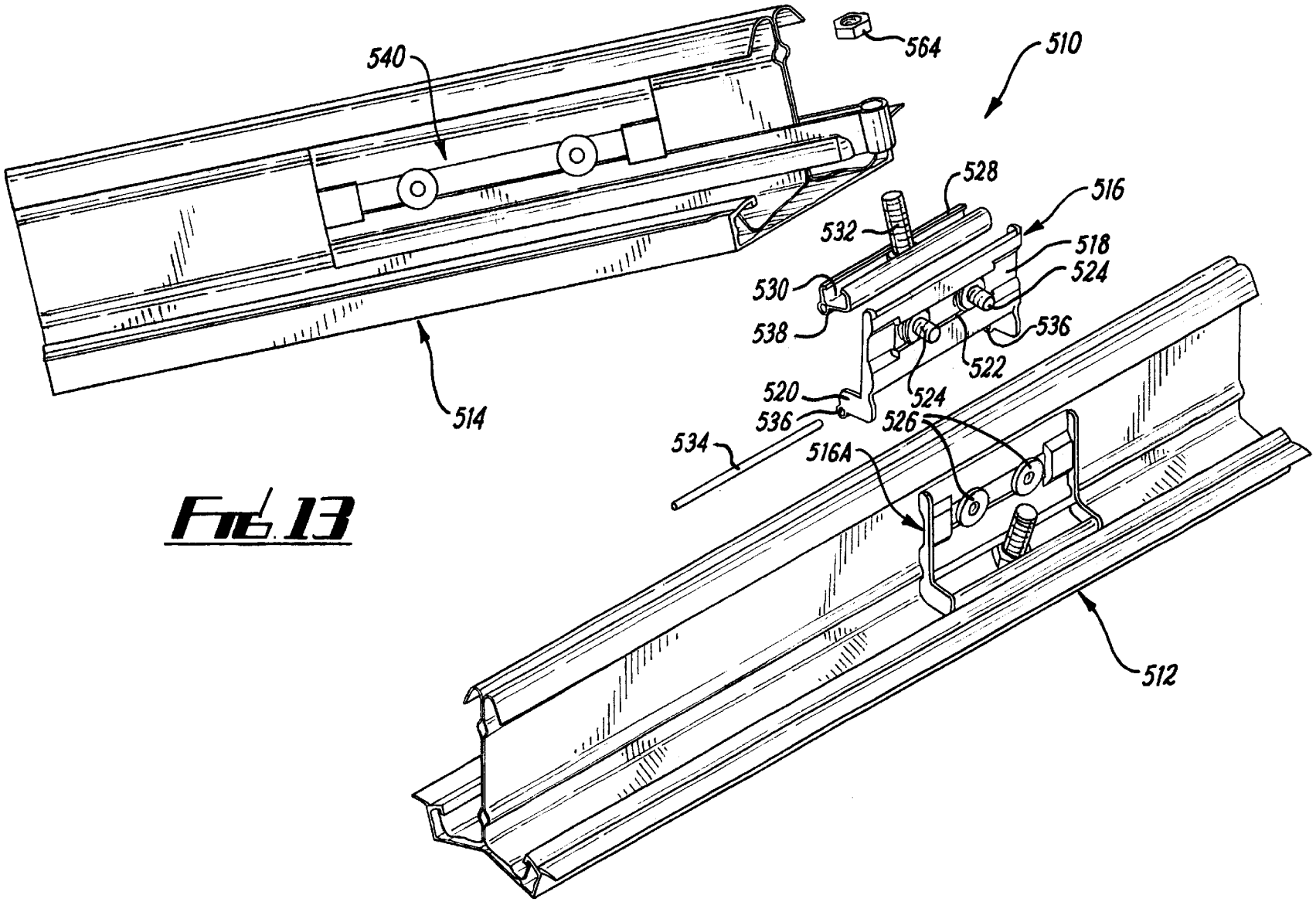
FIG. 13 is a partially exploded view of a bracket arrangement in use on first and second rafter assemblies.
Figure 14:
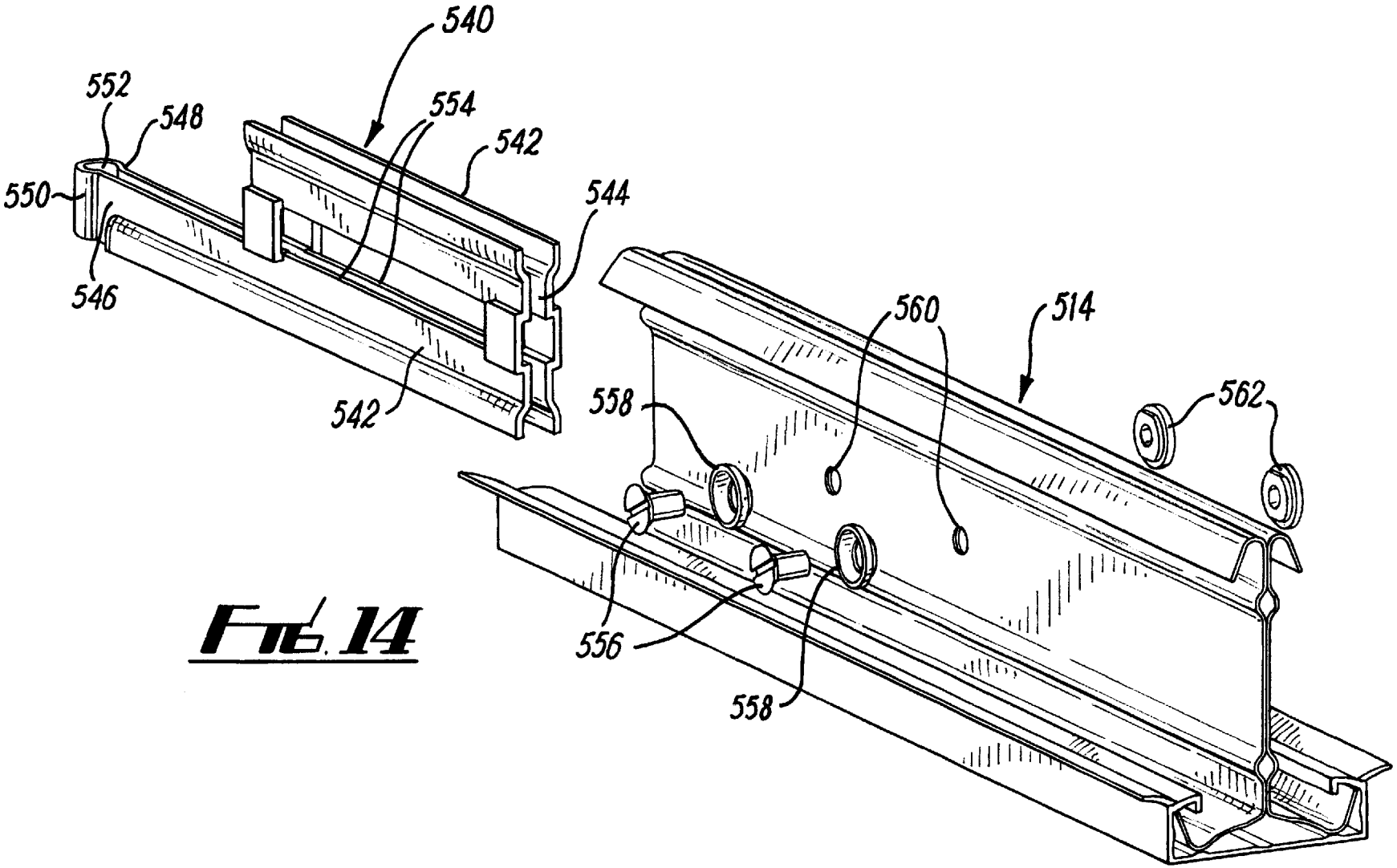
FIG. 14 is a partially exploded view of the second bracket in use on the second rafter assembly.
Figure 15:
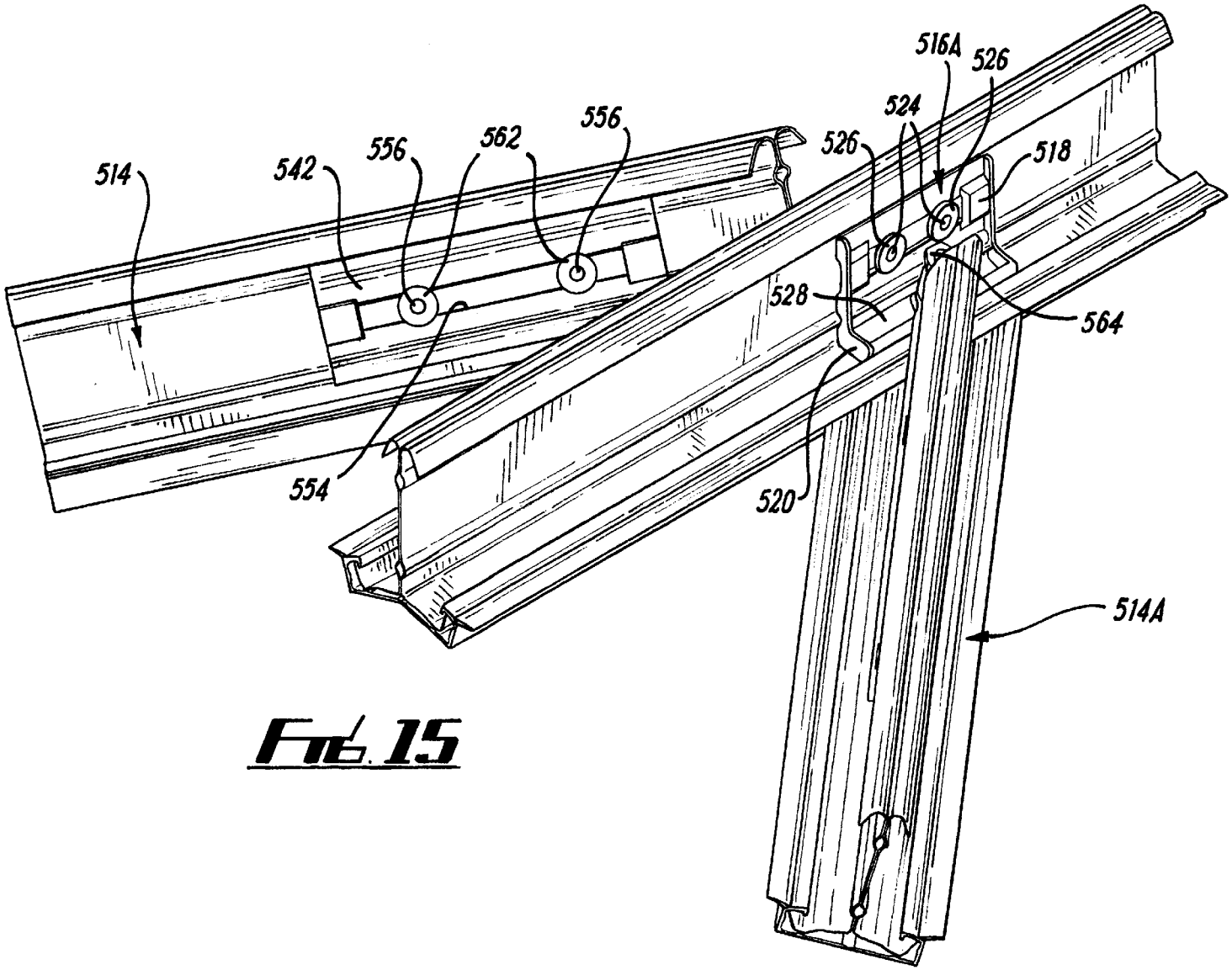
FIG. 15 is a perspective view showing rafter assemblies connected by the bracket arrangement.

Referring to FIGS. 13 to 15, there is shown a bracket arrangement 510 for use in connecting a first rafter assembly 512 to a second rafter assembly 514, such that the second rafter assembly extends transverse from a central region of the first rafter assembly 512.

The bracket arrangement 510 comprises a first bracket 516 which is of a generally L-shaped profile having an upstanding limb 518 and a lower limb 520. The upstanding limb 518 defines a slot 522 through which the shanks of a pair of screws 524 can extend to pass through holes in the first rafter assembly and be threadably tightened onto nuts 526. As can be seen, the first bracket 516 is connected to one side of the first rafter assembly 512 and a further first bracket 516A is secured on the opposite side of the first rafter assembly 512 in a corresponding position to the first bracket 516.

A channel member 528 defining a channel 530 can receive the head of a bolt 532. The channel member 528 is pivotally mounted to the lower limb 520 of the bracket 516 by a pivot rod 534 which extends through channels 536 at opposite ends of the bracket 516 and through a pin receiving cylinder 538 on the channel member 528. Thus the channel member 528 can pivot about the rod 534 to allow the second rafter assembly to be connected thereto at a desired angle.

The bracket arrangement 510 includes a second bracket 540 which is mounted on the second rafter assembly 514. Referring to FIG. 14, it will be seen that the second bracket 540 comprises a pair of plates 542 arranged in mirror image relationship to each other and defining a gap 544 therebetween. A projection 546 extends from the plates 542 and defines at its free end 548 a cylinder 550 defining a bore 552 through which the shank of the bolt 532 can be received and will be explained below.

Each of the plates 542 defines a slot 554 through which screws 556 can extend to secure the second bracket 540 to the second rafter assembly 514. The slots 554 are aligned with each other, and the screws 556 are first received into washers 558 and the bracket 540 is then fitted onto the second rafter assembly 514 such that the two plates 542 are arranged on respective opposite sides of the rafter assembly 514. The shanks of the screws 556 are then passed through the slots 554 and the apertures 560 and nuts 562 are then tightened onto the screws 556.

The second bracket 540 is mounted onto the second rafter assembly 514 such that the projection 546 extends beyond the end of the second rafter assembly 514 to enable it to be attached to the first bracket 516. In order to attach the second bracket 540 to the first bracket 516, the receiving member 550 passes over the shank of the bolt 532 and a nut 564 is then tightened onto the bolt 532 when the second rafter assembly 514 is in the desired position.

As can be seen from FIG. 15, the use of two first brackets 516, 516A enables a pair of second rafter assemblies 514, 514A to be attached to the first rafter assembly 512.

There is thus described in relation to FIGS. 13 to 15 a bracket arrangement which will allow pivoting of the first and second rafter assemblies 512, 514 relative to each other in a vertical plane about the pivot rod 534. The arrangement will also allow pivoting of the first and second rafter assemblies 512, 514 relative to each other in a horizontal plane about the bolt 532.

Various modifications can be made without departing from the scope of the invention.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A beam member for a roof arrangement, the beam member comprising:

a) a main support member and a rafter support member for supporting a rafter assembly;

b) the rafter support member extending outwardly from the main support member;

c) securing means is on the rafter support member at an edge region of the rafter support member;

d) the securing means comprising upstanding means extending from the rafter support member and adapted to cooperate with a part of securing member of a rafter assembly;

e) the upstanding means including a step extending outwardly of the rafter support member and adapted to cooperate with a detent on the securing member; and, f) the upstanding means further including a first upstanding member extending from the rafter support member and a second member extending from the first member back toward the rafter support member outwardly of the rafter support member.

2. A beam member according to claim 1 wherein the rafter support member includes means for holding a cap engaging member.

3. Roof assembly comprising:

a) a beam member including a main support member;

b) a rafter support member for supporting a rafter assembly;

c) the rafter support member extending outwardly from the main support member;

d) securing means on the raft support member at an edge region of the rafter support member at an edge region of the rafter support member;

e) the securing means including upstanding means extending from the rafter support member and adapted to cooperate with a part of a securing member of a rafter sub assembly;

f) the rafter sub assembly including a rafter and a securing member on the rafter to secure the rafter sub assembly to the beam member;

g) the securing member including a co-operating part which can be received in a recess in the securing means to secure the rafter assembly to the beam member;

h) a glazing bar, the securing member comprising a capping means on one end of the glazing bar;

i) the capping means including a first capping member, having the securing member thereon, and a second capping member adjustably attached to the first capping member;

j) the first capping member including means for holding a fastening member to fasten the first capping member to the glazing bar; and, k) the holding means includes a channel member defining a channel having an open side and inwardly extending flange members extending from opposite side walls of the channel member part way across the open side, whereby the channel can receive the head of a bolt.

4. A roof assembly according to claim 3 the cooperating part on the securing member of the rafter assembly can be received in a recess in the securing means to secure the rafter assembly to the beam member.

5. A roof assembly according to claim 4 including the rafter comprises a glazing bar, and the securing member comprises capping means on one end of the glazing bar, the capping means comprising a first capping member, having the securing member thereon, and a second capping member adjustably attached to the first capping member.

6. A roof assembly according to claim 5 wherein the first capping member includes holding means for holding a fastening member to fasten the first capping member to the glazing bar.

7. A roof assembly according to claim 5 wherein each of the first and second capping members comprise respective first and second adjustment means which cooperate with each other to allow adjustment means which cooperate with each other to allow adjustment of the portion of the first capping member relative to the second capping member.

8. Roof assembly comprising:

a) the beam member including a main support member;

b) a rafter support member for supporting a rafter assembly;

c) the rafter support member extending outwardly from the main support member;

d) securing means on the rafter support member at an edge region of the rafter support member;

e) the securing means including upstanding means extending from the rafter support member and adapted to cooperate with a part of a securing member of a rafter sub assembly;

f) the rafter sub assembly, a rafter and a securing member on the rafter to secure the rafter sub assembly to the beam member;

g) the securing member including a co-operating part which can be received in a recess in the securing means to secure the rafter assembly to the beam member;

h) a glazing bar, the securing member comprising a capping means on one end of the glazing bar;

i) the capping means including a first capping member, having the securing member thereon, and a second capping member adjustably attached to the first capping member;

j) each of the first and second capping members being respective first and second adjustments means which cooperate with each other to allow adjustment of the portion of the first capping member relative to the second capping member; and, k) the first and second adjustment means cooperate with each other to adjust the height of the capping means for different heights of glazing bar.

9. A roof assembly according to the first adjustment means comprises a planar member having a plurality of outwardly extending detents arranged in succession in the direction of adjustment of the first and second adjustment means.

10. A roof assembly according to claim 8 wherein the second adjustment means comprises a pair of generally parallel planar members having a plurality of inwardly extending detents arranged in succession in the direction of adjustment of the first and second adjustment means.

11. Roof assembly comprising:

a) the beam member including a main support member;

b) a rafter support member for supporting a rafter assembly;

c) the rafter support member extending outwardly from the main support member;

d) securing means on the rafter support member at an edge region of the rafter support member;

e) the securing means including upstanding means extending from the rafter support member and adapted to cooperate with a part of a securing member of a rafter sub assembly;

f) the rafter sub assembly, a rafter and a securing member on the rafter to secure the rafter sub assembly to the beam member;

g) the securing member including a co-operating part which can be received in a recess in the securing means to secure the rafter assembly to the beam member;

h) a glazing bar, the securing member comprising a capping means on one end of the glazing bar;

i) the capping means including a first capping member, having the securing member thereon, and a second capping member adjustably attached to the first capping member;

j) each of the first and second capping members being respective first and second adjustments means which cooperate with each other to allow adjustment of the portion of the first capping member relative to the second capping member; and, k) the second capping member including a curved portion to engage the glazing bar, wherein the curved portion subscribes an arc and the radius of the arc extends generally from the pivot on the securing member of the first capping member.

12. A roof assembly according to claim 11 wherein the securing member comprises a fastening portion to secure thereto a fastening means for holding the rafter, the securing member further including a securing formation to cooperate with a step provided on the upstanding means to secure the securing member thereto.

13. A roof assembly according to claim 12 wherein the securing member includes a stop member to engage the rafter support member to prevent or inhibit movement of the clip holding means.

14. Roof assembly comprising:

a) the beam member including a main support member;

b) a rafter support member for supporting a rafter assembly;

c) the rafter support member extending outwardly from the main support member;

d) securing means on the rafter support member at an edge region of the rafter support member;

e) the securing means including upstanding means extending from the rafter support member and adapted to cooperate with a part of a securing member of a rafter sub assembly;

f) the rafter sub assembly, a rafter and a securing member on the rafter to secure the rafter sub assembly to the beam member;

g) the securing member including a co-operating part which can be received in a recess in the securing means to secure the rafter assembly to the beam member;

h) a glazing bar, the securing member comprising a capping means on one end of the glazing bar;

i) the capping means including a first capping member, having the securing member thereon, and a second capping member adjustably attached to the first capping member;

j) each of the first and second capping members being respective first and second adjustments means which cooperate with each other to allow adjustment of the portion of the first capping member relative to the second capping member; and, k) the securing member including a fastening portion to secure thereto a fastening means for holding the rafter;

l) the securing member further including a securing formation to cooperate with a step provided on the upstanding means to secure the securing member thereto; and, m) the fastening portion includes a channel member defining a channel having an open side and a pair of flanges extending inwardly from opposite side walls of the channel member part way across the open side.

* * * * *